US006232935B1

(12) United States Patent
Fukushima et al.

(10) Patent No.: US 6,232,935 B1
(45) Date of Patent: May 15, 2001

(54) PLASMA DISPLAY PANEL AND METHOD FOR DRIVING THE SAME

(75) Inventors: Masakazu Fukushima, Suwon; Jeong-duk Ryeom, Seoul, both of (KR)

(73) Assignee: SamSung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/066,898

(22) Filed: Apr. 28, 1998

(30) Foreign Application Priority Data

Sep. 1, 1997 (KR) ..... 97-45383

(51) Int. Cl.[7] ..... G09G 3/28
(52) U.S. Cl. ..... 345/67
(58) Field of Search ..... 345/60–69; 315/169.1–169.4

(56) References Cited

U.S. PATENT DOCUMENTS

| | | | | |
|---|---|---|---|---|
| 5,420,602 | * | 5/1995 | Kanazawa | 345/67 |
| 5,446,344 | | 8/1995 | Kanazawa . | |
| 6,057,815 | * | 5/2000 | Sano | 345/60 |

FOREIGN PATENT DOCUMENTS

| | | |
|---|---|---|
| 0488326 | 6/1992 | (EP) . |
| 0488891 | 6/1992 | (EP) . |
| 0680067 | 11/1995 | (EP) . |
| 0762373 | 3/1997 | (EP) . |
| 2220330 | 9/1990 | (JP) . |
| 5119738 | 5/1993 | (JP) . |
| 5232901 | 9/1993 | (JP) . |
| 64039 | 1/1994 | (JP) . |
| 7-199858 | 8/1995 | (KR) . |

* cited by examiner

*Primary Examiner*—Dennis-Doon Chow
*Assistant Examiner*—Amr Awad
(74) *Attorney, Agent, or Firm*—Leydig, Voit & Mayer, Ltd

(57) ABSTRACT

An AC surface discharge plasma display panel and a method for driving the same are provided. In the method for driving the AC surface discharge plasma display panel according to the present invention, a parallel driving method is used, which is known to have better brightness characteristics than a separate driving method in which the addressing is separate from the discharge sustaining, in which the addressing and discharge sustaining are simultaneously performed. Periods between the discharge sustaining pulses applied to the scanning electrodes and the common electrodes are set as the address time slots periods, a plurality of data pulses are applied in the address time slot periods, and a number of common electrodes equal to the number of data pulses are wired as one common electrode group and are driven by the same signal, in order to solve the restrictions on the number of the horizontal scanning lines which can be scanned, which is a defect of conventional parallel drive methods.

9 Claims, 34 Drawing Sheets

PLASMA DISPLAY PANEL AND METHOD FOR DRIVING THE SAME

BACKGROUND OF THE INVENTION

1. Field of the Invention

The present invention relates to an AC surface discharging plasma display panel, and more particularly, to a surface discharging plasma display panel according to an electrode wiring structure and a method for driving the plasma display panel for displaying gray scales.

2. Description of Related Art

A plasma display panel is of a display device for displaying picture data input as an electrical signal by arranging a plurality of discharge tubes in a matrix and by selectively emitting light from them. Methods for driving the plasma display panel are divided into DC driving methods and AC driving methods according to whether the polarity of a pulse voltage applied in order to sustain the discharge changes over time.

FIG. 1A is a sectional view of a DC opposite surface discharge plasma display panel. FIGS. 2A and 2B are respectively a sectional view and perspective view of an AC surface discharge plasma display panel. As shown in the drawings, in both DC and AC types, a discharge space is formed between upper glass plates 1 or 7 and lower glass plates 4 or 12. In the DC plasma display panel, the flow of electrons is from a negative pole becomes a main energy source for sustaining the discharge, since a scanning electrode 2 and an address electrode 5 are directly exposed to a discharge space 3. In the AC plasma display panel, a scanning electrode 6*a* and a common electrode 6*b* for sustaining the discharge are electrically separated from a discharge space 10 by a dielectric layer 8. In the case of the AC plasma display panel, the discharge is sustained by a well known wall charge effect. Namely, the discharge occurs only in a place where the wall charge exists, since a discharge resuming voltage is the sum of a wall voltage and an applied voltage. The discharge is continuously sustained in the place where the discharge first occurred, since the discharge replenishes the wall charge.

Electrode structures are divided into opposite surface discharge structures and surface discharge structures. Namely, the opposite surface discharge electrodes have a structure in which electrodes for generating the discharge are on opposite surfaces of the discharge space. On the other hand, the surface discharge electrodes have a structure in which the electrodes for generating the discharge are both arranged in the same plane, as shown in FIG. 2A. Electrode structures are also divided into two electrode structures and three electrode structures, according to the number of electrodes installed for realizing a discharge.

FIG. 2B shows the three electrode surface discharge structure of the plasma display panel in common use. An address electrode 11 is opposite and perpendicular to the two parallel display electrodes, i.e., the scanning electrode 6*a* and the common electrode 6*b*. The discharge spaces are defined by latticed walls. In the structure, the discharge for generating the wall charge is generated in order to select pixels between the address electrode 11 and the scanning electrode 6*a*. Then, the discharge for displaying pictures is maintained for a certain time between the scanning electrode 6*a* and the common electrode 6*b*. A latticed wall 17 defines the discharge spaces and prevents cross talk between adjacent pixels by intercepting light generated by the discharge. The pixels are constructed by forming a plurality of unit structures on a substrate in a matrix and applying a fluorescent material to the unit structures. Such pixels form a plasma display panel. In the plasma display panel in common use, when the discharge is generated in a pixel, ultraviolet rays generated by the discharge excite the fluorescent material coating on the inner wall of the pixel, thus realizing a desired color.

Displaying gray scales is a prerequisite for displaying colors on the plasma display panel. A method of dividing a 1TV field into a plurality of auxiliary fields and time division controlling them is used for realizing gray scales. FIG. 3 describes the gray scale display method of the AC plasma display panel. This is a 6 bit gray scale display method, in which a TV fields is divided into 6 auxiliary fileds (SF1, SF2, . . . , SF6) and each auxiliary field is divided into address periods (A1, A2, . . . , A6) and discharge sustaining periods (S1, S2, S3, . . . , S6). Here, the pixels of the display panel are selected during the address periods (A1, A2, . . . , A6). The gray scales of the pixels selected during the address periods are displayed by the combination of the discharge sustaining periods (S1, S2, S3, . . . , S6). 64 gray scales may be displayed by this method. Namely, 64 gray scale levels 0 to 63 are selected from the plasma display panel having 480 scanning lines (Y1, Y2, . . . , Y480). For example, the gray scales are displayed as follows; 0(0T), 1(1T), 2(2T), 3(1T+2T), 4(4T), 5(1T+4T), 6(2T+4T), 7(1T+2T+4T), 8(8T), 9(1T+8T), . . . , 27(1T+2T+8T+16T), . . . , 63(1T+2T+4T+8T+16T+32T).

FIG. 4 shows an example of the electrode wiring structure of the AC plasma display panel in common use. In the structure, there are two sets of parallel electrodes (X and Y electrodes), horizontally facing each other in pairs, and address electrodes 21, perpendicular to the X and Y electrodes. Here, the X electrodes are common electrodes and are connected in common. The Y electrodes are scanning electrodes. The waveforms of a drive signal for driving the AC plasma display panel having the present wiring structure are shown in FIG. 5. The address discharge and the sustaining discharge are separately driven by the drive signal. In FIG. 5, the waveforms of an address discharge drive signal (A), scanning electrode drive signals (Y1, Y2, . . . , Y480), and a common electrode drive signal(X) are shown. Here, only the signal of a first sub-field (SF1) is shown. A1 and S1 respectively denote a first address period and a first discharge sustaining period. The address period (A1; the first address period) is constructed by the erasing period having a complete erasing period (A11), a complete writing period (A12), a complete erasing period (A13), and an actual address period (A14). During the erasing period (A11, A12, and A13), the wall charges generated by a previous discharge are erased in all cells by generating a weak discharge (A11), new wall charges are written (A12) in all cells, and the new wall charges are partially erased in all cells (A13) so that only appropriate wall charges remain in order to correctly display gray scales. Accordingly, the next auxiliary field (SH2) operates smoothly. During the address period (A14), the wall charge is formed by the scanning electrode in a place on the screen of the plasma display panel selected by a selective discharge by a write pulse between the address electrode and the scanning electrode, and information is written by electric signal. During the discharge sustaining period (S1), image information is realized as gray scales by the discharge generated by continuous discharge sustaining pulses. In the discharge sustaining period(S1), light is continuously emitted.

However, in the gray scale method of the plasma display panel, the discharge sustaining period (S1) is assigned on the basis of an NTSC level of a 6 bit gray scale and amounts to less than 30% of a one frame image display period since the address discharge is driven separately from the sustaining discharge. Therefore, the brightness of the plasma display panel is very low, which is a serious drawback. In the case of being applied to a high definition display device, the discharge sustaining period is further reduced to ½ of the present level, thus the brightness is even more severely lowered. Also, when a larger number of gray scales are made available, the discharge sustaining period is again reduced, thus also reducing the brightness. In order to improve the brightness, more pulse rows may be applied in 1 sub-field by increasing the frequency and narrowing the width of the discharge sustaining pulse. In the case of increasing the frequency of the discharge sustaining pulse, the space charge caused by the discharge generated by one pulse affects the discharge characteristic of the next discharge, since the rows of discharge sustaining pulses periodically coincide, and thus the discharge becomes unstable. Accordingly, the increase of the brightness reaches saturation. In the case of narrowing the width of the discharge sustaining pulse, the discharge sustaining voltage increases since less time is available for converting the space charge generated after the discharge into the wall charge.

To solve such problems, a method such as the one shown in FIG. 6 is used. This method simultaneously drives the addressing discharge and the sustaining discharge, instead of separately driving the addressing discharge and the sustaining discharge. In the method, address pulses 29*a*, 29*b*, and 29*c* are applied in the periods between the discharge sustaining pulses 32 applied to the respective scanning electrodes Y1, Y2, and Y3. Erasing pulses 31*a* and 31*b* for performing the igniting and scanning pulses 33*a*, 33*b*, and 33*c* for performing the addressing discharge are applied to the periods between the discharge sustaining pulses 32 applied to the scanning electrodes Y1, Y2, and Y3. Then, the length of the discharge sustaining period is set. A method of using the entire 1TV frame for sustaining the discharge by dividing the 1TV frame into auxiliary frames (SF1 through SF8) as shown in FIG. 7 is used for displaying the gray scales. However, there are many restrictions in determining the timing for inserting the address pulses since the address pulses must be inserted between the discharge sustaining pulses. Therefore, the number of displayable scanning lines is limited, and it is difficult to drive the addressing discharge and sustaining discharge of a high definition display. In order to solve these problems, the discharges must be driven at a high speed, such as two or three times normal speed. In this case, the discharge becomes unstable due to the increase of the frequency and the discharge sustaining voltage increases due to the reduction of the width of the discharge sustaining pulse, as mentioned above.

SUMMARY OF THE INVENTION

It is an object of the present invention to provide a plasma display panel in which timing of inserting an address pulse between discharge sustaining pulses is not restricted and the increase of the frequency or the voltage of discharge sustaining pulses is not required, by setting address time slot periods constructed of a plurality of data pulses between discharge sustaining pulses, dividing pairs of horizontal electrodes into a plurality of groups, each of which includes pairs of horizontal electrodes as many as the data pulses of an address time slot period and driving the pairs of horizontal electrodes, sequentially scanning the scan pulses corresponding to each data pulse during the address time slot period to each pairs of horizontal electrodes of the group, and applying to the groups a method of simultaneously addressing and sustaining discharge.

To achieve the above object, there is provided an AC plasma display panel having a k×n n matrix, comprising k pairs of first and second electrodes arranged parallel with each other on a first substrate, and n third electrodes arranged perpendicular to the first and second electrodes on a second substrate which is parallel to the first substrate, wherein the first electrodes are separately driven and the second electrodes are grouped into p common wiring groups, each common wiring group including m adjacent second electrodes, which are driven by the same signal.

In the present invention, the equation, $k=m\times a$ is established.

Each common wiring group includes every p'th second electrode, which are driven by the same signal.

To achieve the above object, there is provided an AC plasma display panel driving method for displaying a picture of a realizing gray scales by dividing a horizontal synchronization period into a plurality of sub-periods, sequentially applying different numbers of discharge sustaining pulses, to the first and second electrodes, on an AC plasma display panel having a k×n n matrix in which k pairs of first and second electrodes are arranged parallel with each other on a first substrate and n third electrodes are arranged perpendicular to the first and second electrodes on a second electrodes on a second substrate which is parallel to the first substrate, when the second electrodes are called common electrodes and are grouped into p common wiring groups and the first electrodes are called scanning electrodes and are separately installed, comprising the steps of (a) setting address time slot periods in the period during which the discharge sustaining pulses are not applied and applying a plurality of data pulses to an address electrode during the respective address time slot periods, and (b) selecting the common wiring groups one by one so as to correspond to the plurality of data pulses and sequentially applying scanning pulses corresponding to the plurality of data pulses which correspond to the common electrodes of the selected common wiring groups.

In the present invention, a number of address time slots periods equal to the number of reference gray scale bits are repeatedly applied, corresponding to the respective horizontal synchronization periods to the address electrodes, the scanning electrodes are sequentially selected, corresponding to the respective address time slot periods, and gray scale display periods of selected corresponding to the selected scanning electrodes, preceding the gray display period of the previously selected scanning electrode by one bit. Preferably, the data pulses are negative and the discharge sustaining pulses are positive. Preferably, the data pulses are negative and the discharge sustaining pulses are negative. Preferably, the data pulses are positive and the discharge sustaining pulses are positive. Preferably, the data pulses are positive and the discharge sustaining pulses are negative. Preferably, the width of the data pulse is less than 2 $\mu$s.

Also, in the present invention, when the discharge sustaining pulses applied to the common electrode are disposed symmetrically about the discharge sustaining pulses applied to the scanning electrode, the address time slots periods are included only in a periods during which the discharge sustaining pulses are not applied and which either precede or follow the scanning pulses on the basis of the discharge sustaining pulses applied to the scanning electrode. Preferably, the data pulses are negative and the discharge sustaining pulses are positive. Preferably, the data pulses are negative and the discharge sustaining pulses are negative. Preferably, the data pulses are positive and the discharge sustaining pulses are positive. Preferably, the data pulses are positive and the discharge sustaining pulses are negative.

Also, in the present invention, when the discharge sustaining pulses applied to the common electrode are disposed symmetrically about the discharge sustaining pulses applied to the scanning electrode, the address time slot periods are included in the periods during which the discharge sustaining pulses are not applied and which both precede and follow the scanning pulses on the basis of the discharge sustaining pulses applied to the scanning electrode. Preferably, the data pulses are negative and the discharge sustaining pulses are negative. Preferably, the data pulses are positive and the discharge sustaining pulses are negative. Preferably, the data pulses are positive and the discharge sustaining pulses are positive. Preferably, the data pulses are positive and the discharge sustaining pulses are negative.

Also, in the present invention, when the discharge sustaining pulses applied to the common electrode are disposed asymmetrically about the discharge pulses applied to the scanning electrode, the address time slots are included the longer of the two periods to which the discharge sustaining pulses are not applied and which precede and follow the scanning pulses. Preferably, the data pulses are negative and the discharge sustaining pulses are positive. Preferably, the data pulses are negative and the discharge sustaining pulses are negative. Preferably, the data pulses are positive and the discharge sustaining pulses are positive.

Preferably, the data pulses are positive and the discharge sustaining pulses are negative.

Also, in the present invention, it is preferable to further comprise, before the step (a), the steps of forming wall charges in every pairs of first and second electrodes by applying igniting pulses to the pairs of first and second electrodes before performing the addressing and selectively applying the addressing pulses and the scanning pulses to the addressing electrodes and the scanning electrodes and erasing the wall charges only in selected pixels. Preferably, the wall charges generated during a a previous gray scale display period are erased by making the width of the final discharge sustaining pulse narrower than those of the other discharge sustaining pulses among the respective gray scale displaying periods. Preferably, the wall charges are naturally recreased by inserting a period of less than 100 $\mu$sec after the final discharge sustaining pulse among the respective gray scale displaying periods. Preferably, the width of the final discharge sustaining pulses is less than 2 $\mu$s.

Also, in the present invention, it is preferable to further comprise, before the step (a), the steps of erasing the wall charges in every pair of first and second electrodes by applying the igniting pulses to the pairs of the first and second electrodes before performing the addressing and selectively applying the data pulses and the scanning pulses to the addressing electrodes and the scanning electrodes and forming the wall charges only in selected pixels. Preferably, the wall charges generated during a previous gray scale displaying period are erased by making the width of the final discharge sustaining pulse narrower than those of the other discharge sustaining pulses among the respective gray scale displaying pulses. Preferably, the wall charges are naturally decreased by inserting a period of less than 100 $\mu$sec after the final discharge sustaining pulse among the respective gray scale displaying periods. Preferably, the width of the final discharge sustaining pulse is less than 2 $\mu$s.

Also, in the present invention, the address time slot period and a stopping slot for invalidating a plurality of data pulses applied to the address time slot period are alternately included, and the stopping slot included in the igniting pulse applied during the address time slot period is not simultaneously applied with the address pulse applied during the address time slot period.

BRIEF DESCRIPTION OF THE DRAWING(S)

The above object and advantages of the present invention will become more apparent by describing in detail a preferred embodiment thereof with reference to the attached drawings in which.

Figure 8A:
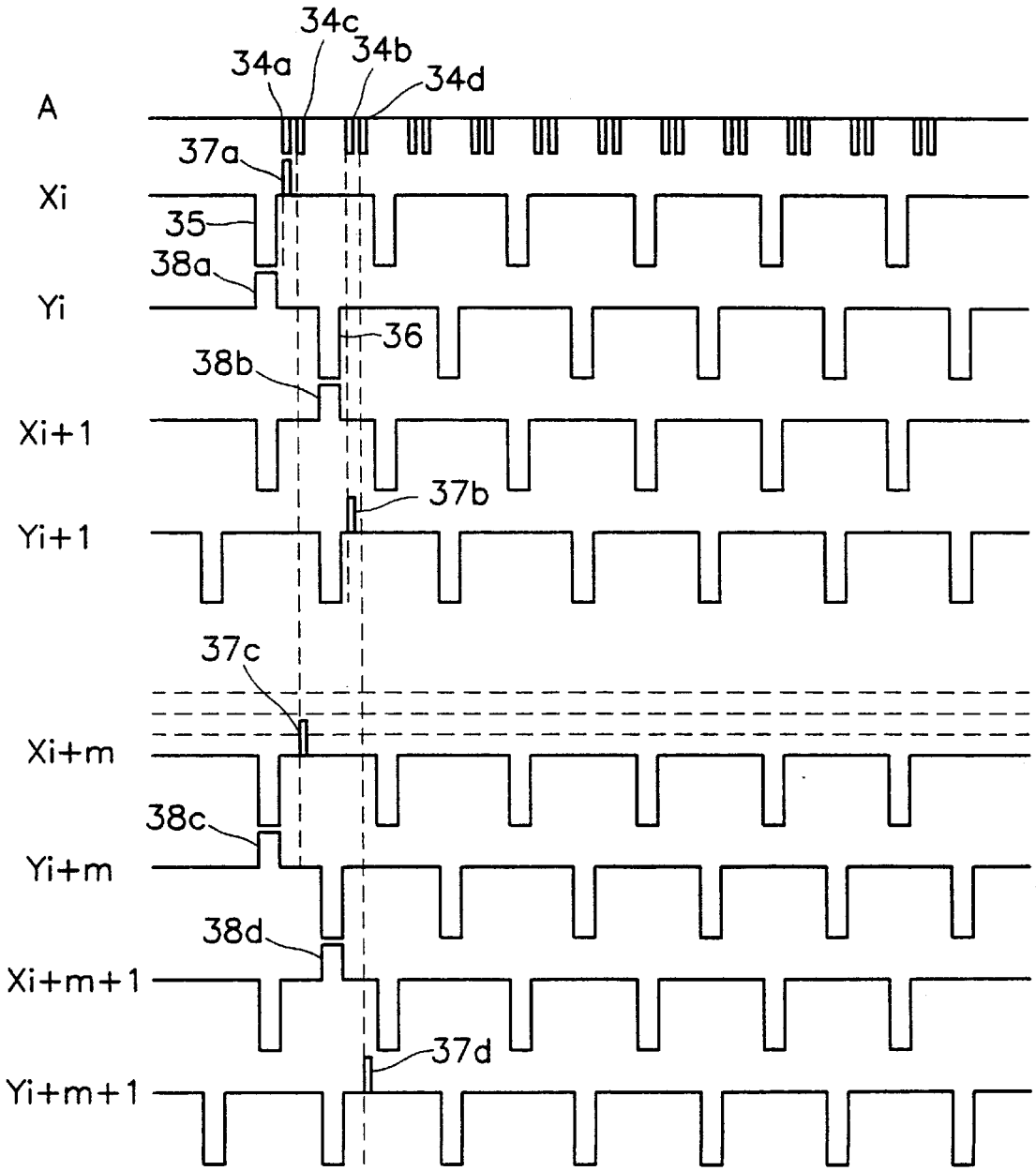
FIGS. 8A and 8B show fundamental drive waveforms of a method for simultaneously driving the address electrode and the scanning electrode according to the present invention.
Figure 8B:
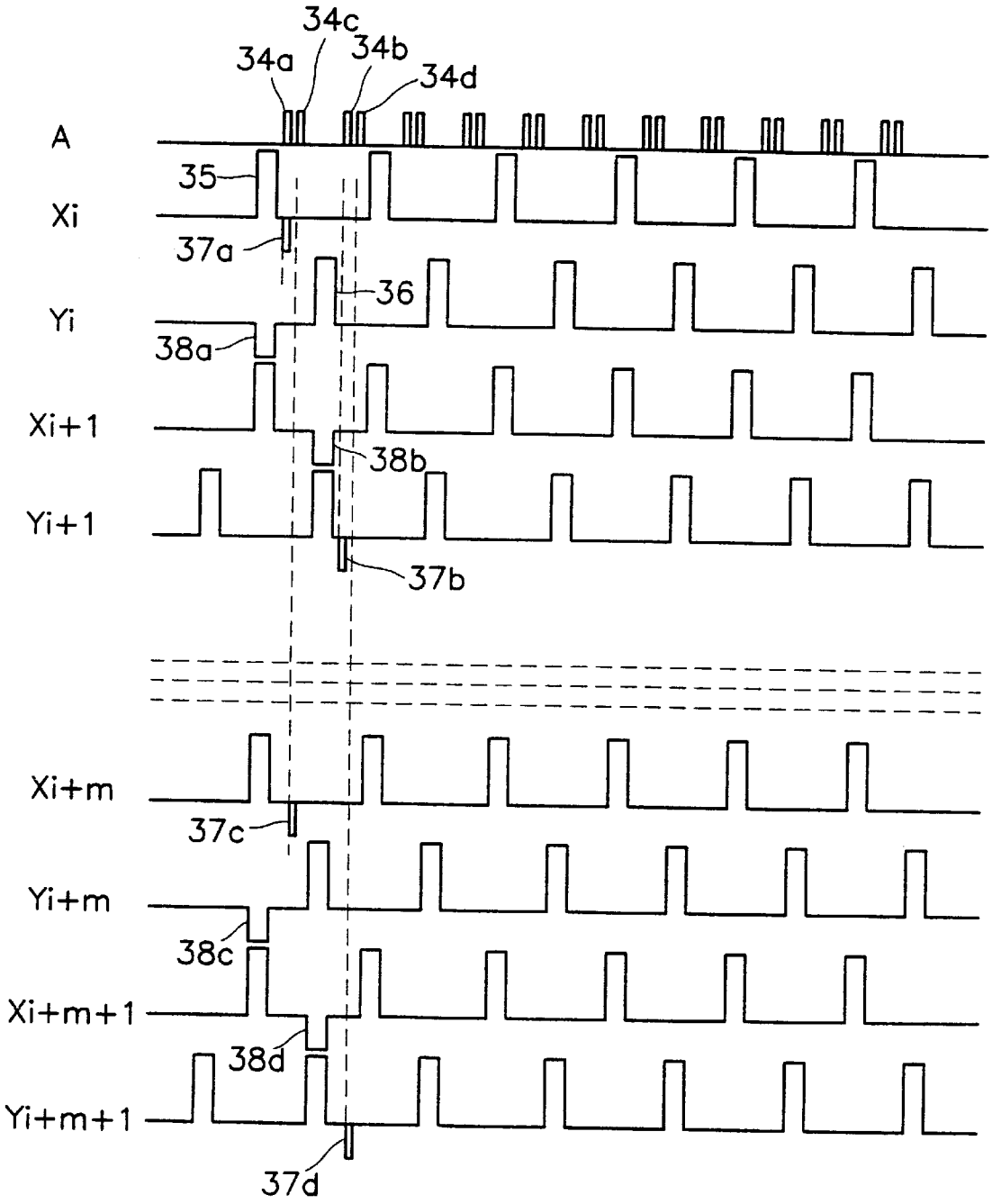
Figure 12:
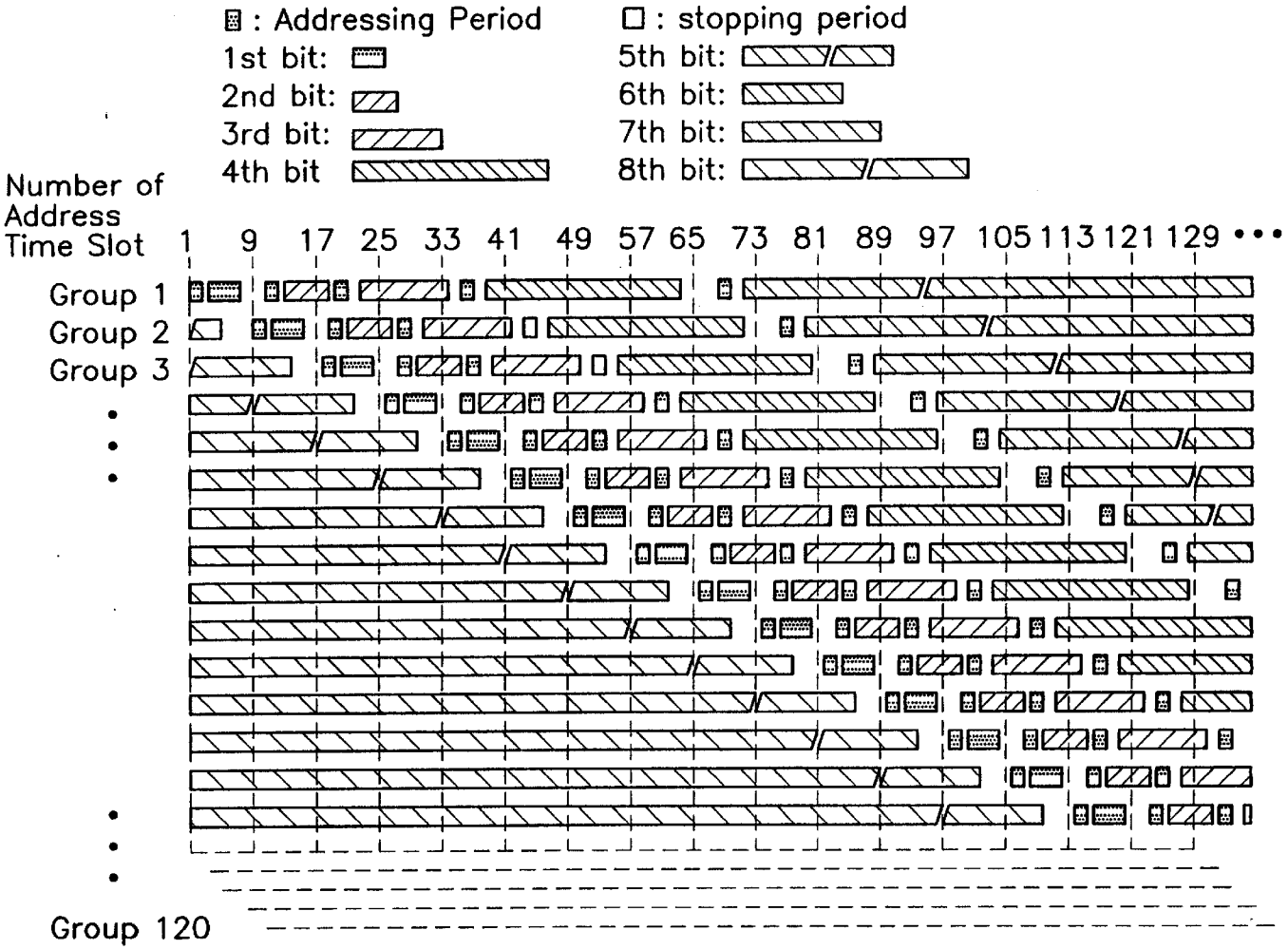
Figure 13:
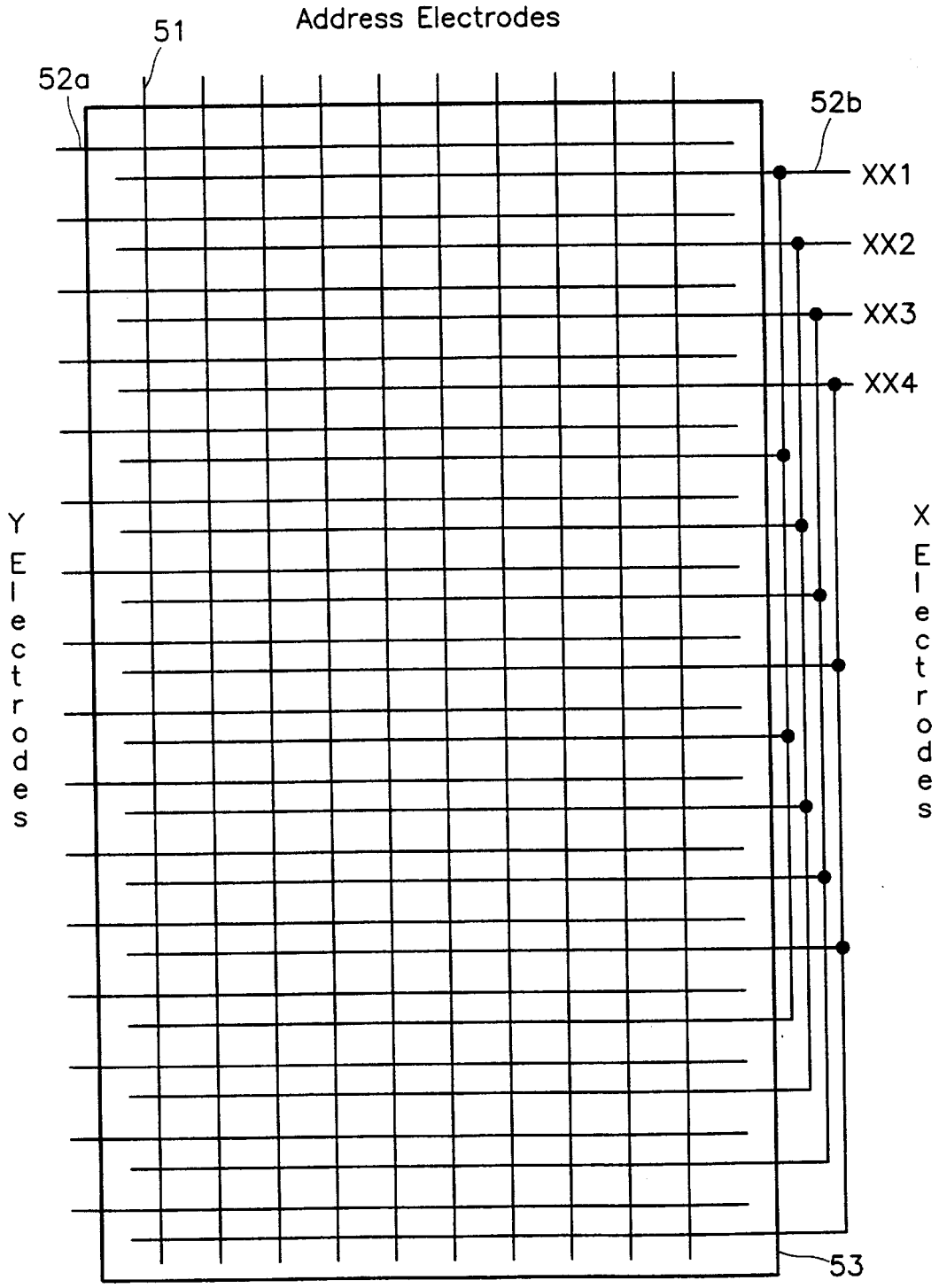
Figure 14A:
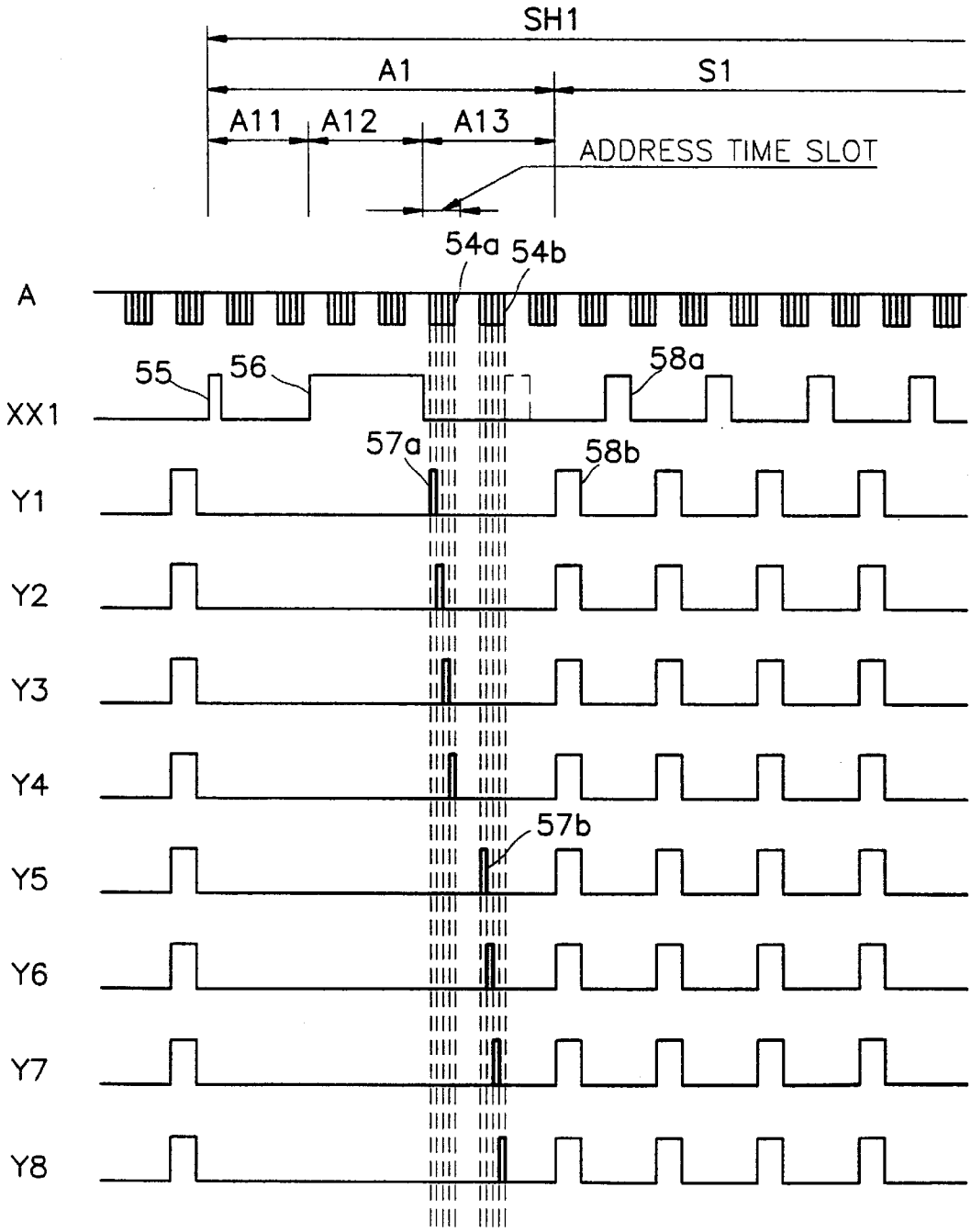
Figure 14B:
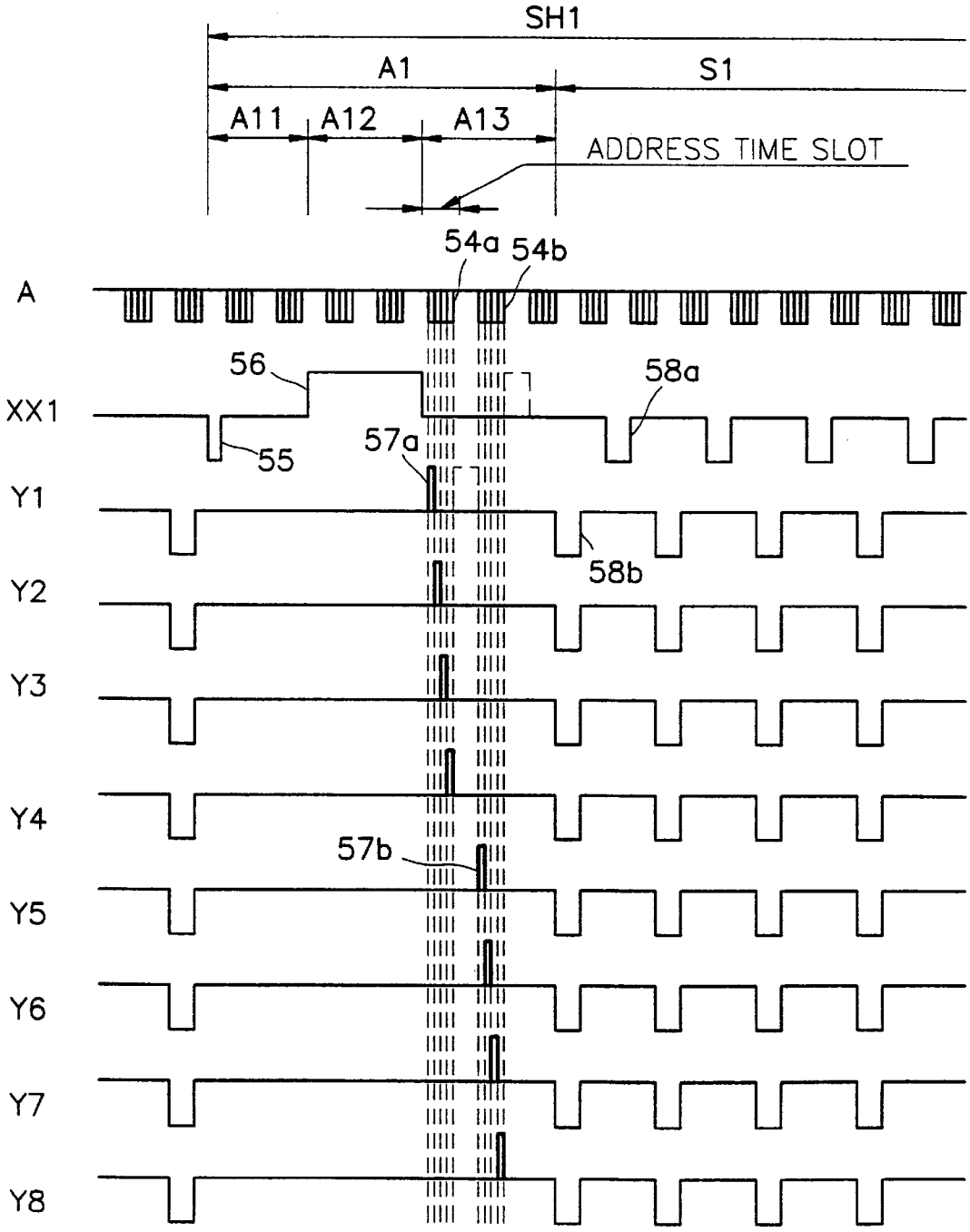
Figure 14C:
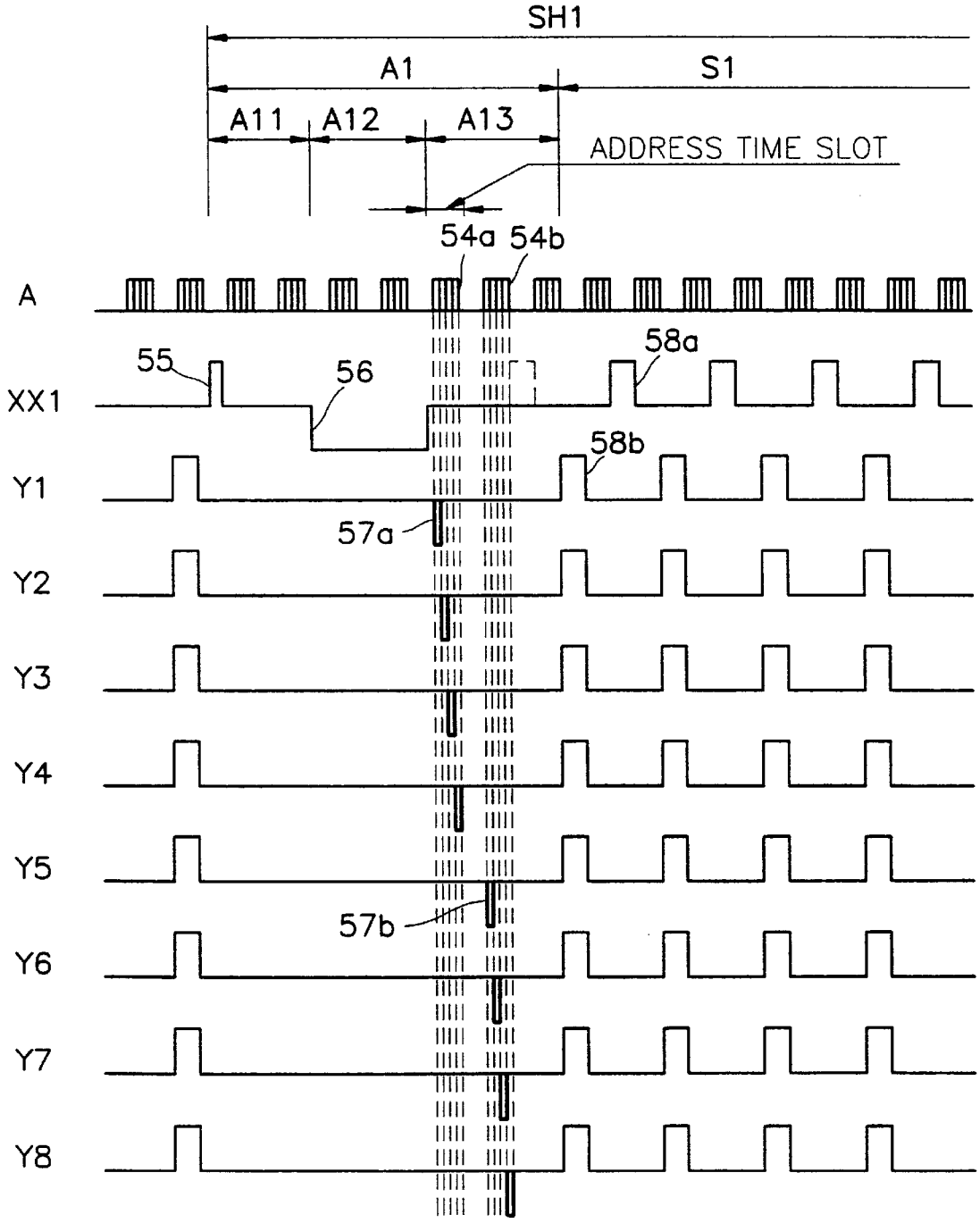
Figure 14D:
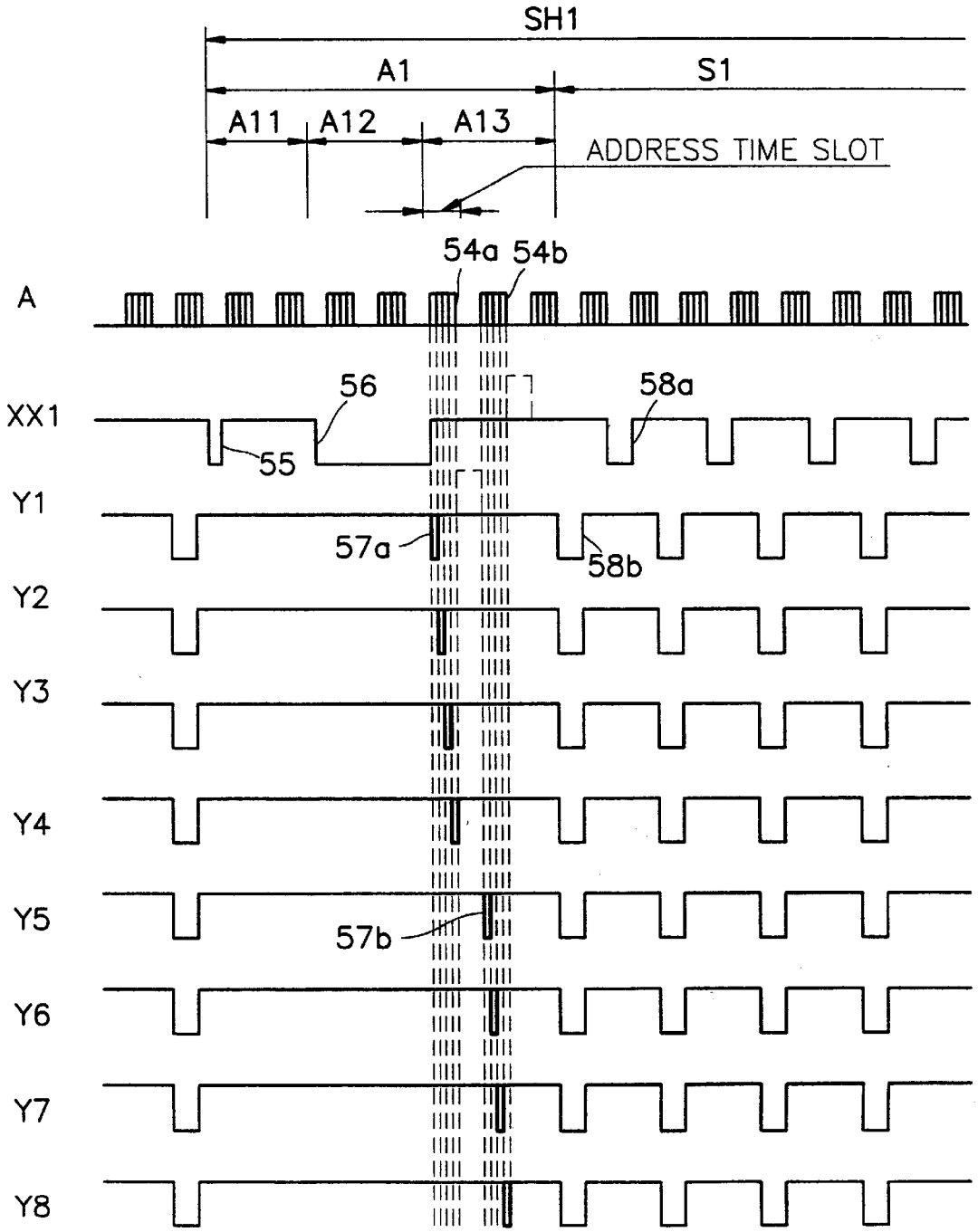
Figure 15:
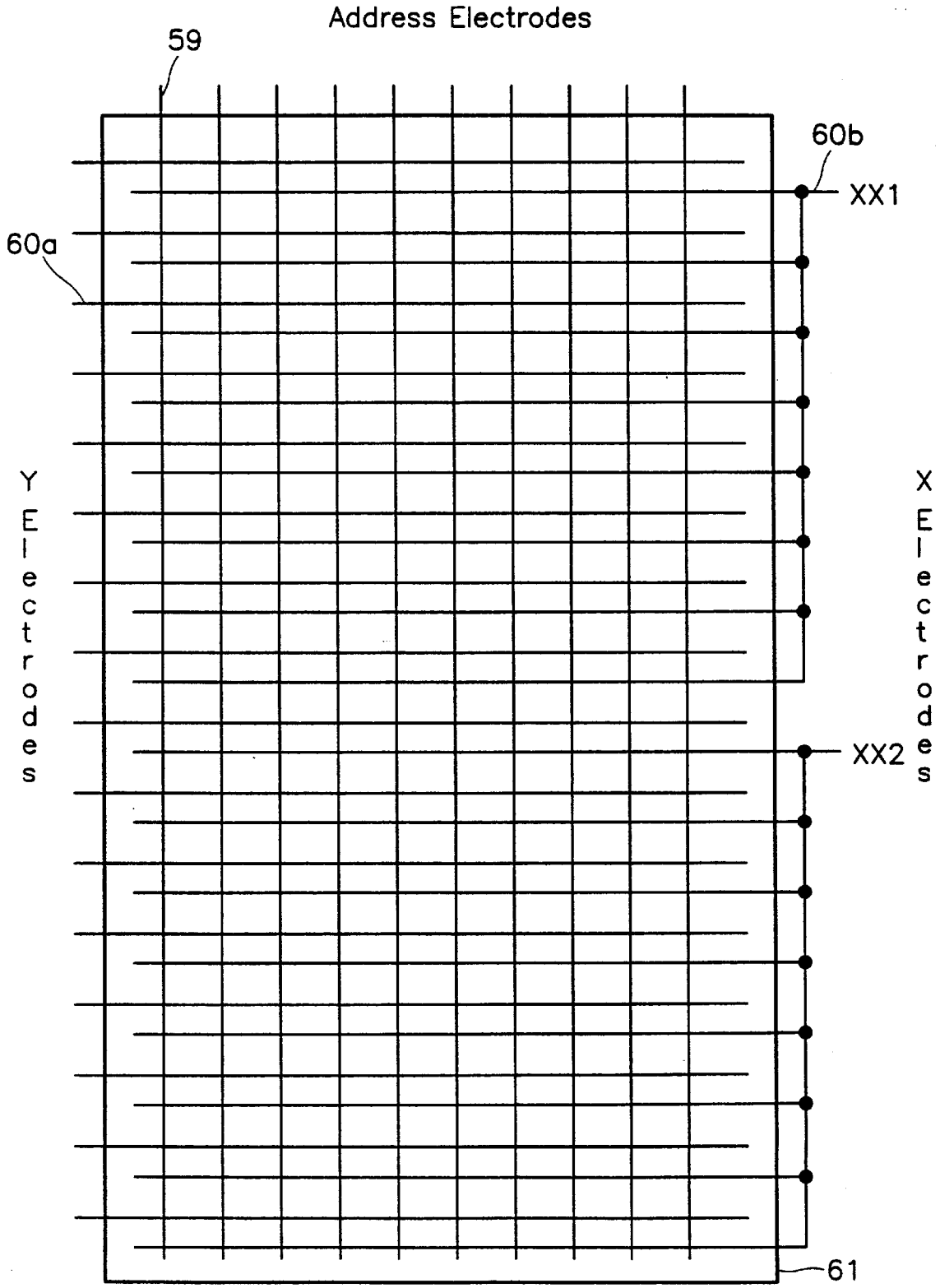
Figure 16:
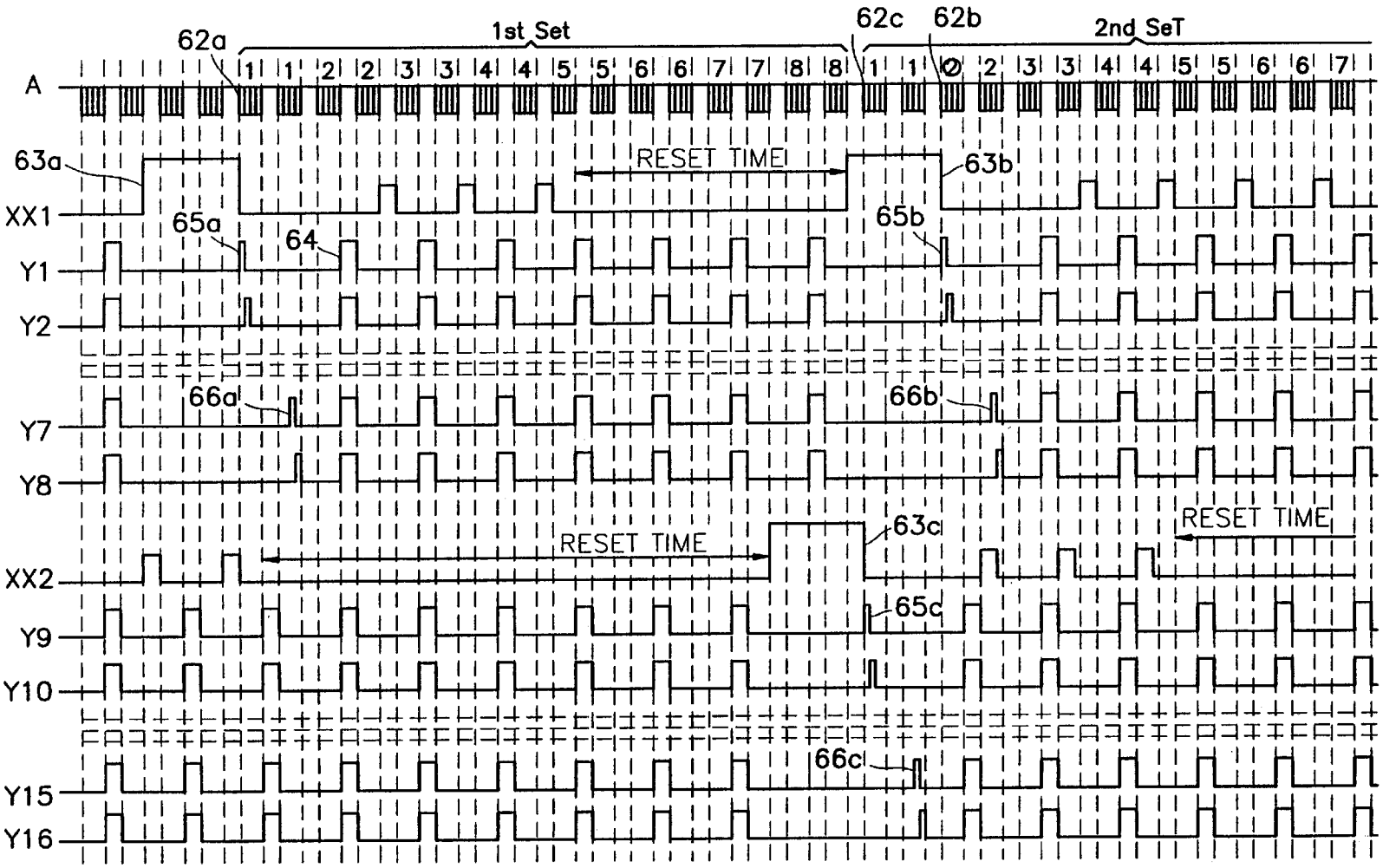
Figure 17:
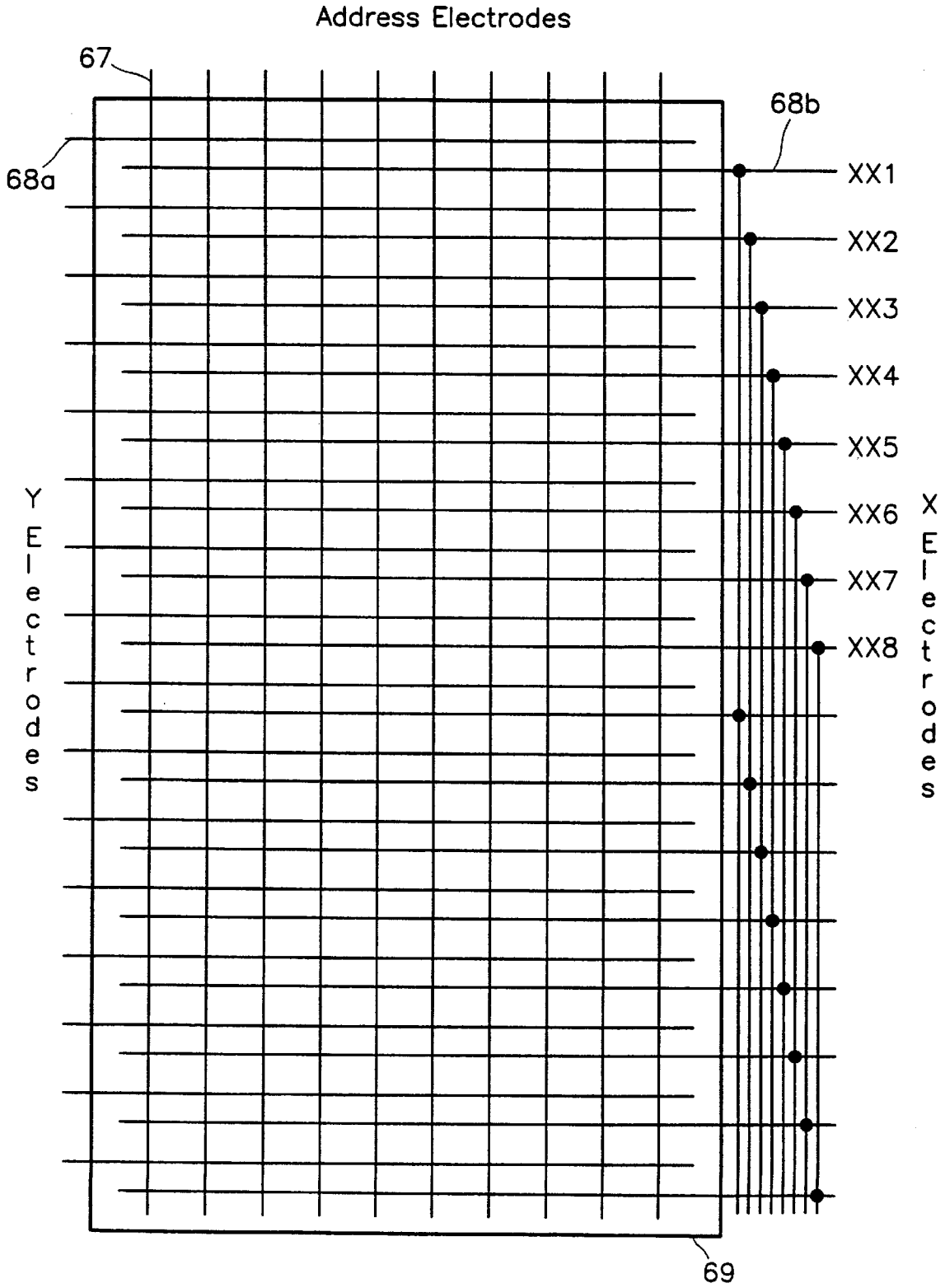
Figure 18A:
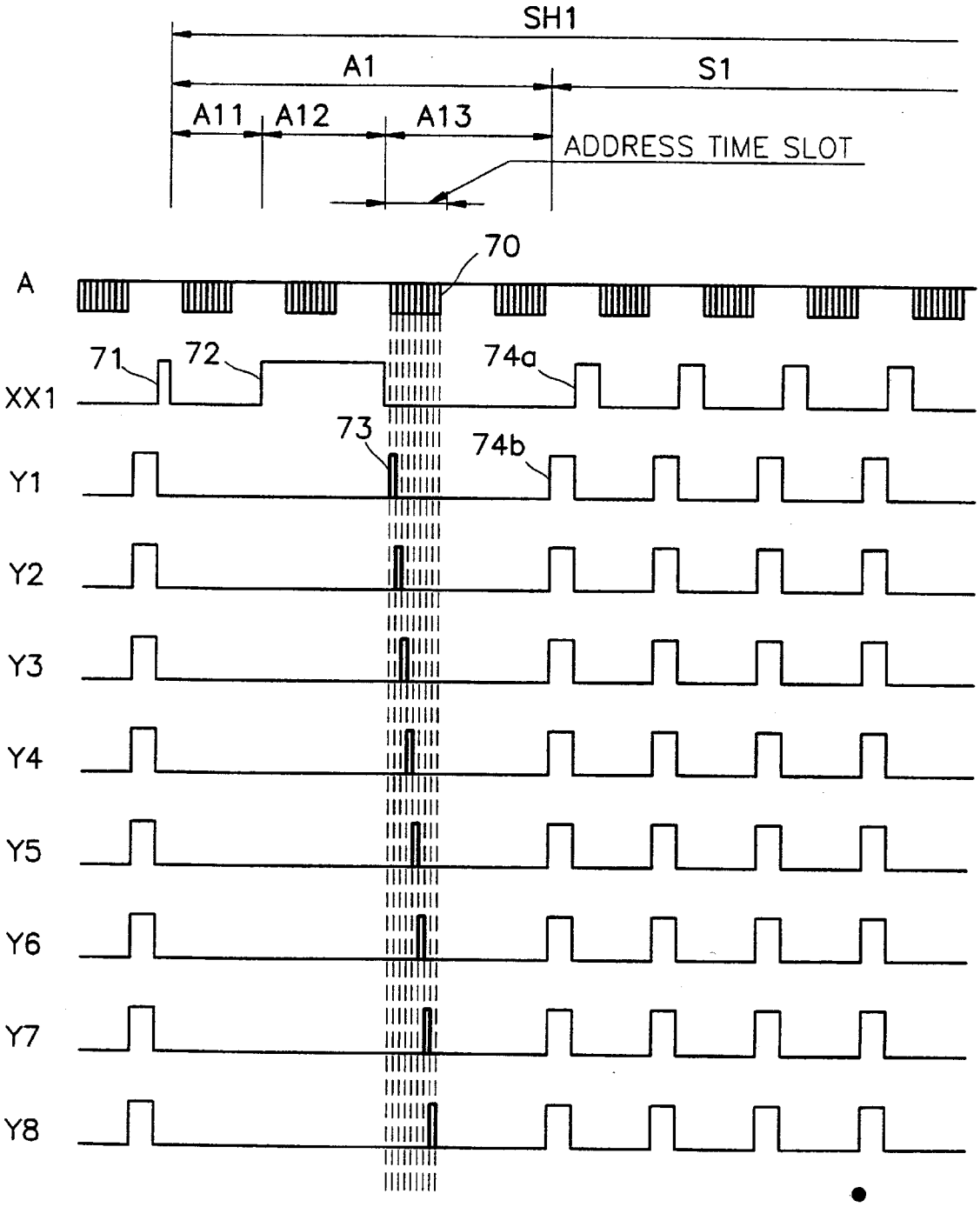
Figure 19:
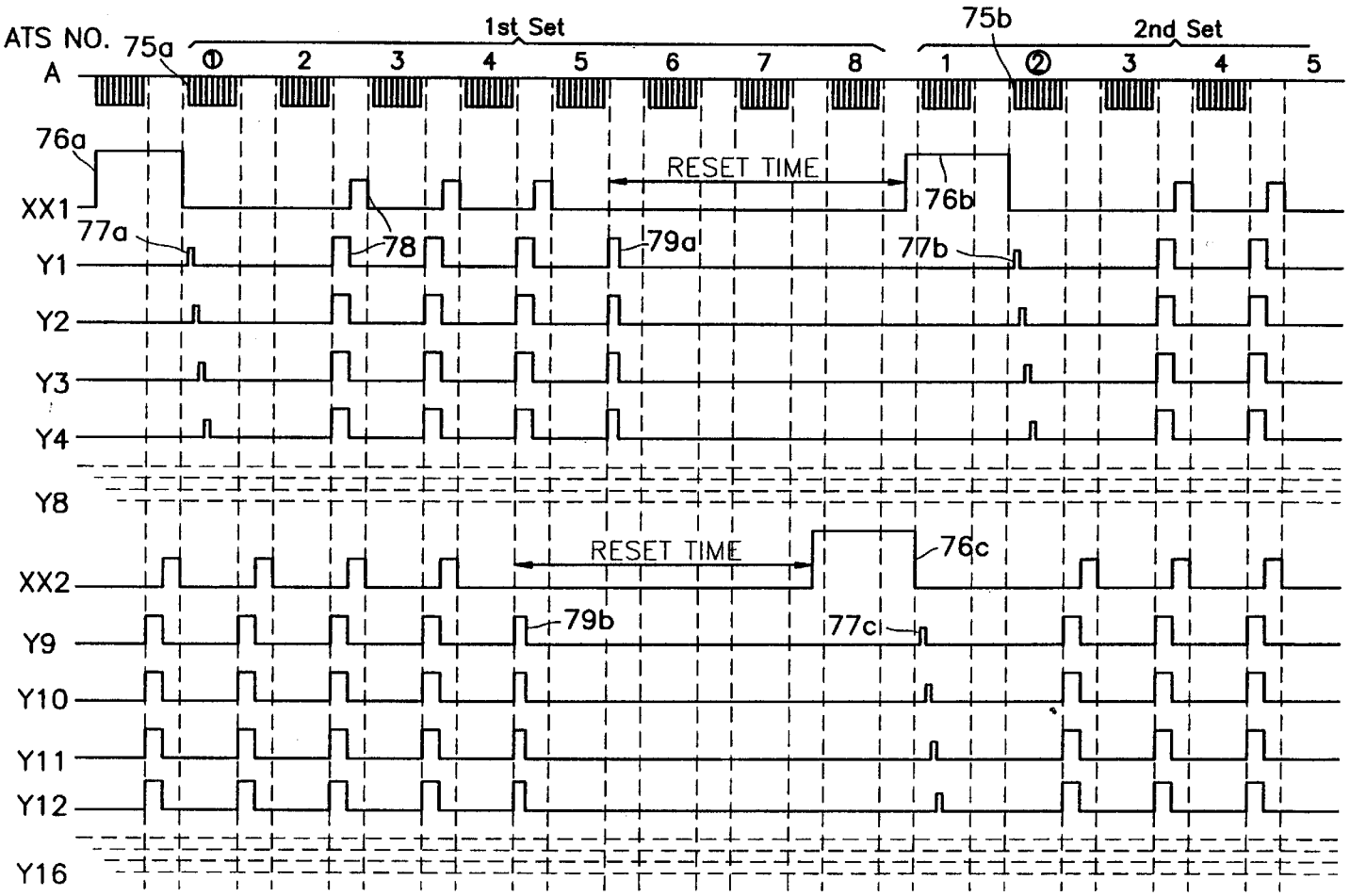
Figure 20:
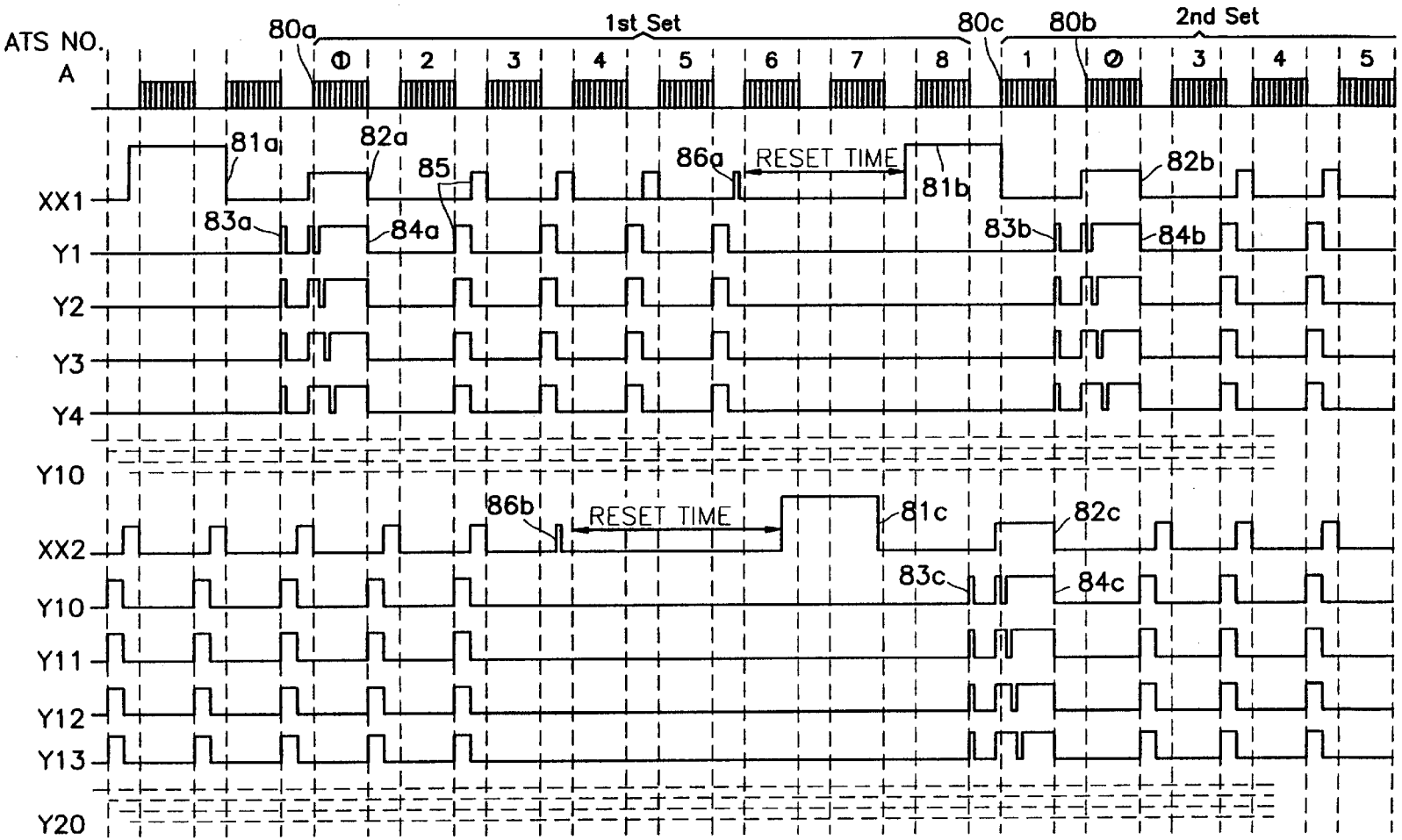
Figure 21:
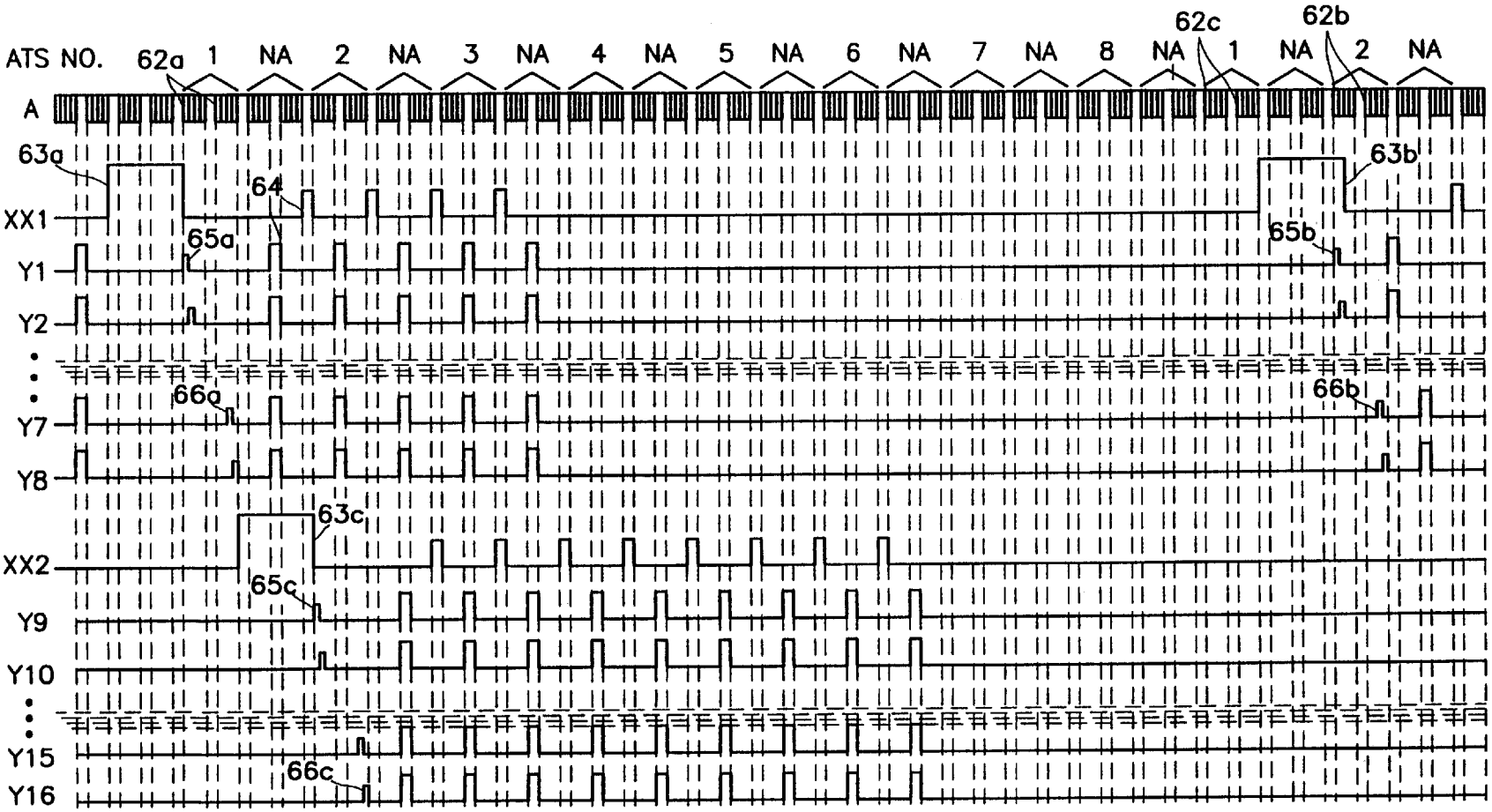

FIG. 12 describes the gray scale display method based on the electrode driving principle of FIGS. 8A and 8B;

FIG. 13 shows another electrode wiring structure which may be used when applying the method of FIGS. 8A and 8B for simultaneously driving the address electrode and the scanning electrode;

FIGS. 14A through 14D show the drive waveforms of eight electrode groups when applying the method of FIGS. 8A and 8B for simultaneously driving the address electrode and the scanning electrode;

FIG. 15 shows the electrode wiring of the eight electrode groups, used when applying the drive signals of FIGS. 14A through 14D;

FIG. 16 shows in detail the waveforms of the electrode drive signal for driving the 8 electrode group of FIG. 14A;

FIG. 17 shows another electrode wiring structure of the eight electrode groups, used when applying the drive signals of FIGS. 14A through 14D;

FIGS. 18A through 18D show the electrode drive waveforms of a method for applying asymmetrical pulses, based on the principle of FIGS. 8A and 8B;

FIG. 19 shows in detail waveforms of FIG. 18A;

FIG. 20 shows in detail the waveforms of the electrode drive signals in a variation of the method for applying the asymmetrical pulse; and FIG. 21 shows in detail the waveforms of another embodiment of the eight electrode group drive signals of FIG. 16.

DESCRIPTION OF THE PREFERRED EMBODIMENT(S)

A plasma display panel according to the present invention and a method for driving the same will now be described in detail with reference to the attached drawings.

In the present invention, the electrode wiring structure and the voltage application method of a three electrode AC plasma display panel are improved so that a brightness is increased over the conventional method and the increased brightness is maintained even when the number of horizontal scanning lines increases. Namely, an address time slot constructed by a plurality of data pulses is set between discharge sustaining pulses of a three electrode AC plasma display panel. The horizontal electrodes are divided into pairs, and the pairs are arranged in groups. The number of pairs in each group is equal to the number of address time slots. One electrode of each pair of horizontal electrodes is commonly wired with the corresponding electrodes of every other group. The other electrodes are independently wired. The address time slots corresponding respectively to the pairs in each group are sequentially scanned. The groups are important in a method for simultaneously driving the addressing and sustaining. The plasma display panel having such a structure and a method for driving the same will now be described in more detail.

Figure 1:
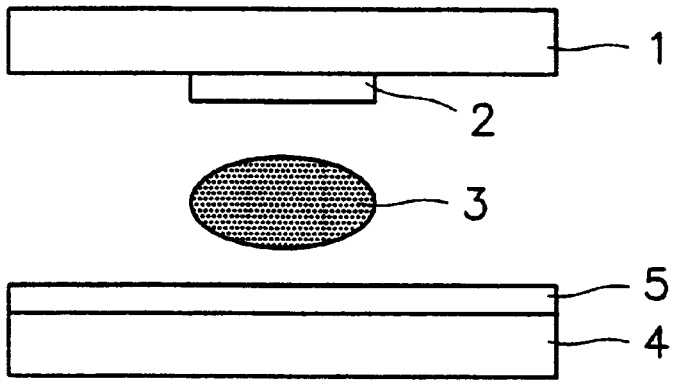
FIG. 1 (PRIOR ART)
FIG. 1 is a sectional view of a general DC opposite surface discharge plasma display panel.
Figure 2A:
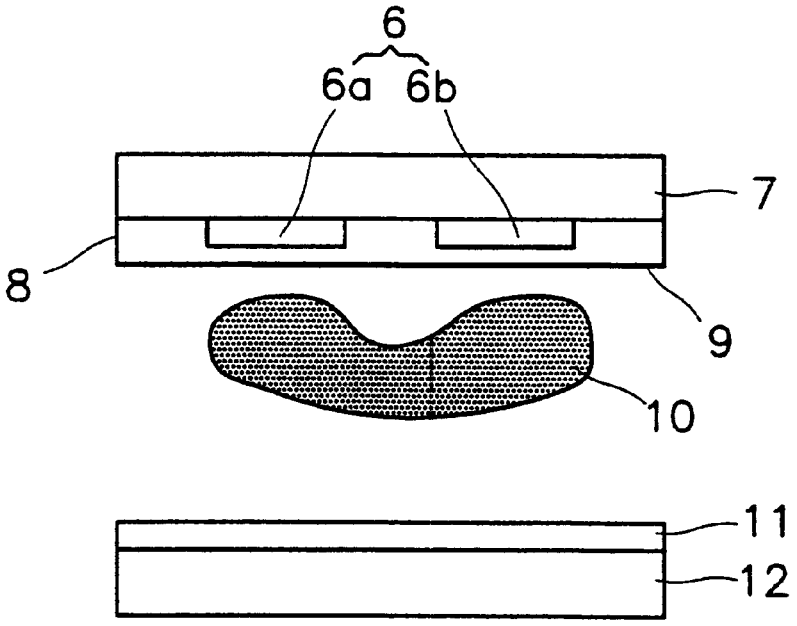
FIG. 2A (PRIOR ART)
FIG. 2A is a sectional view of a general AC surface discharge plasma display panel.
Figure 2B:
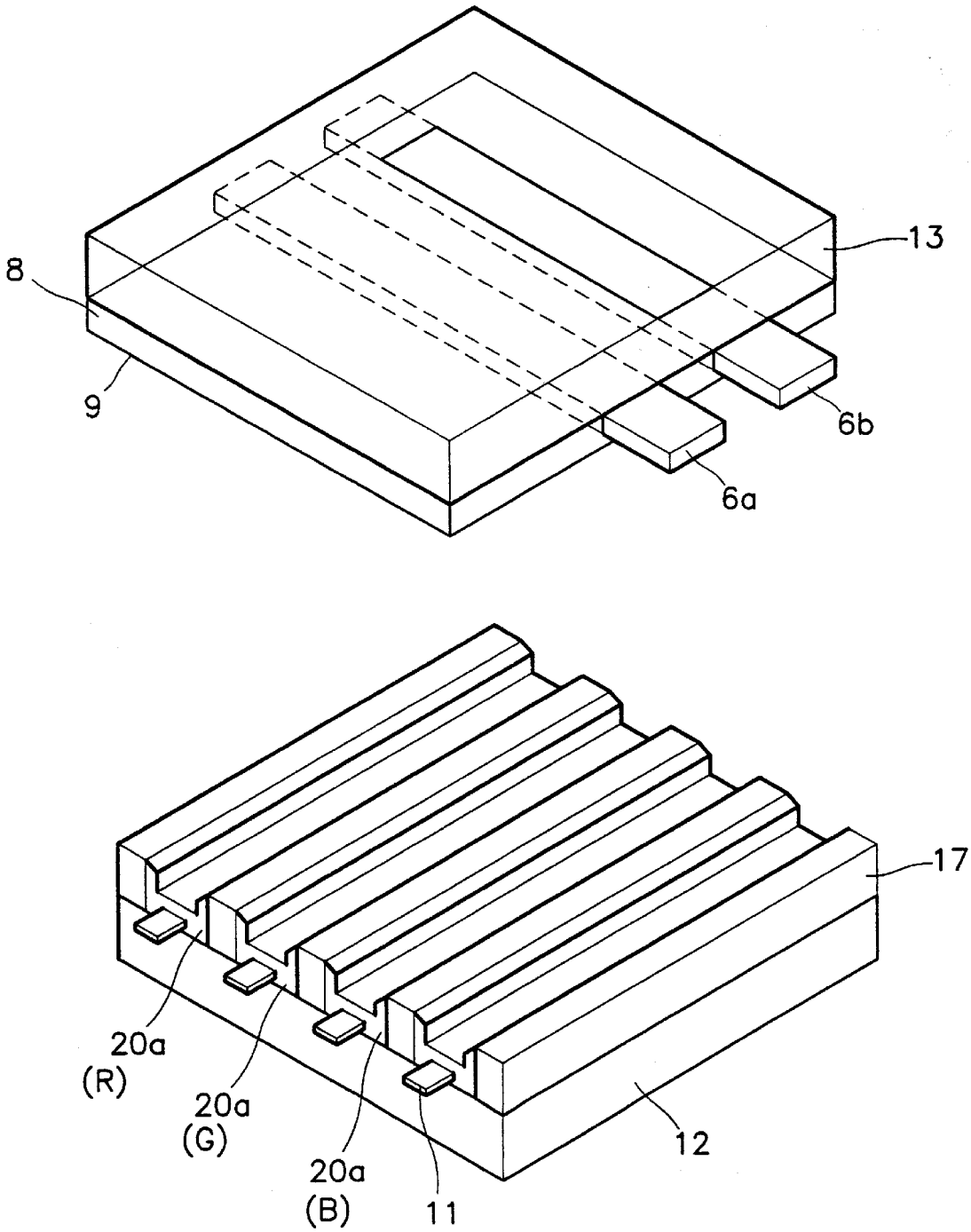
FIG. 2B is a perspective view of the AC surface discharge plasma display panel of FIG. 2A.
Figure 3:
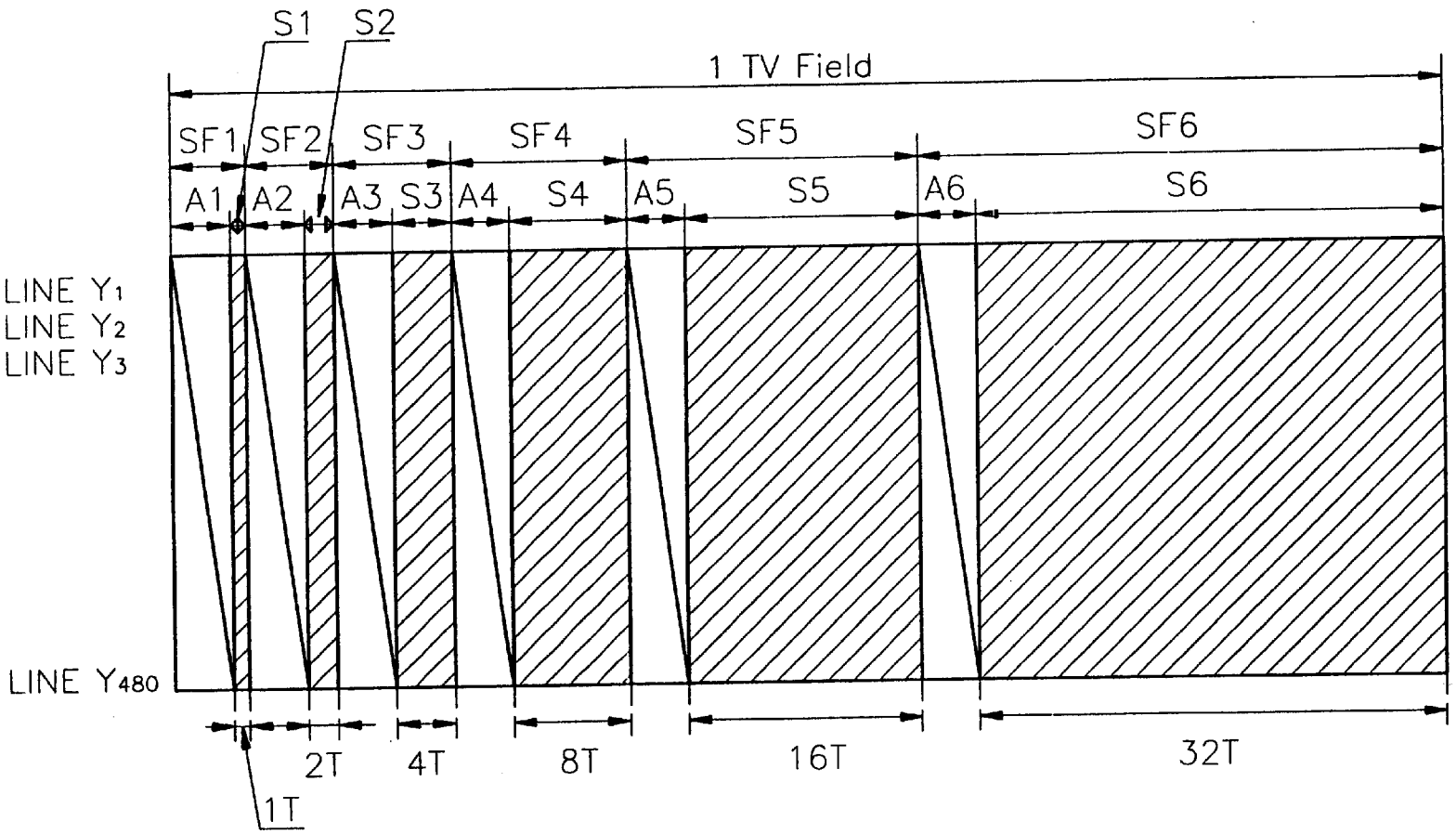
FIG. 3 (PRIOR ART)
FIG. 3 illustrates a gray scale display method of the AC surface discharge plasma display panel of FIG. 2A.
Figure 4:
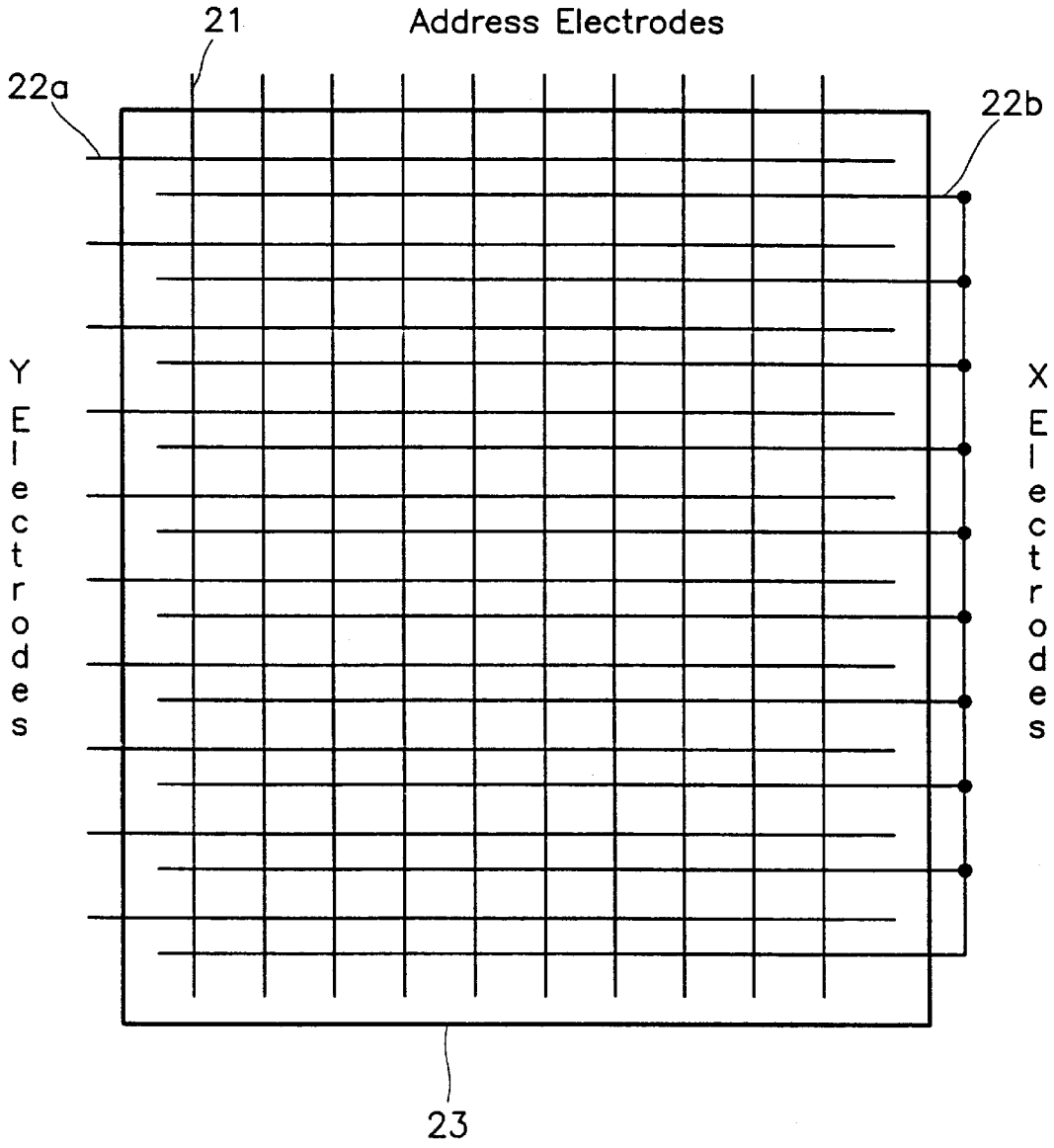
FIG. 4 (PRIOR ART)
FIG. 4 shows the electrode wiring structure of a conventional AC surface discharge plasma display panel.
Figure 5:
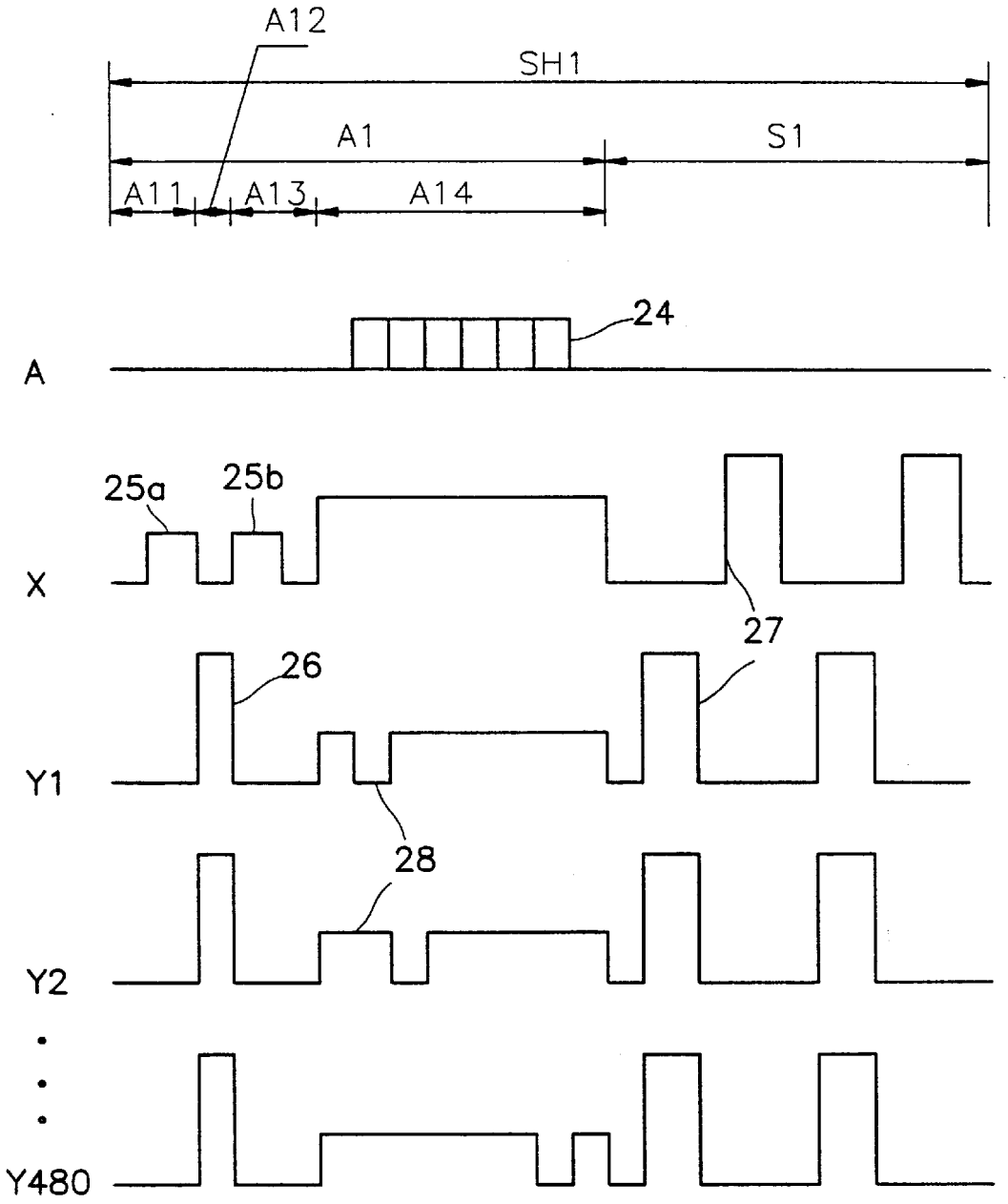
FIG. 5 (PRIOR ART)
FIG. 5 shows waveforms of a drive signal according to the electrode wiring structure of FIG. 4.
Figure 6:
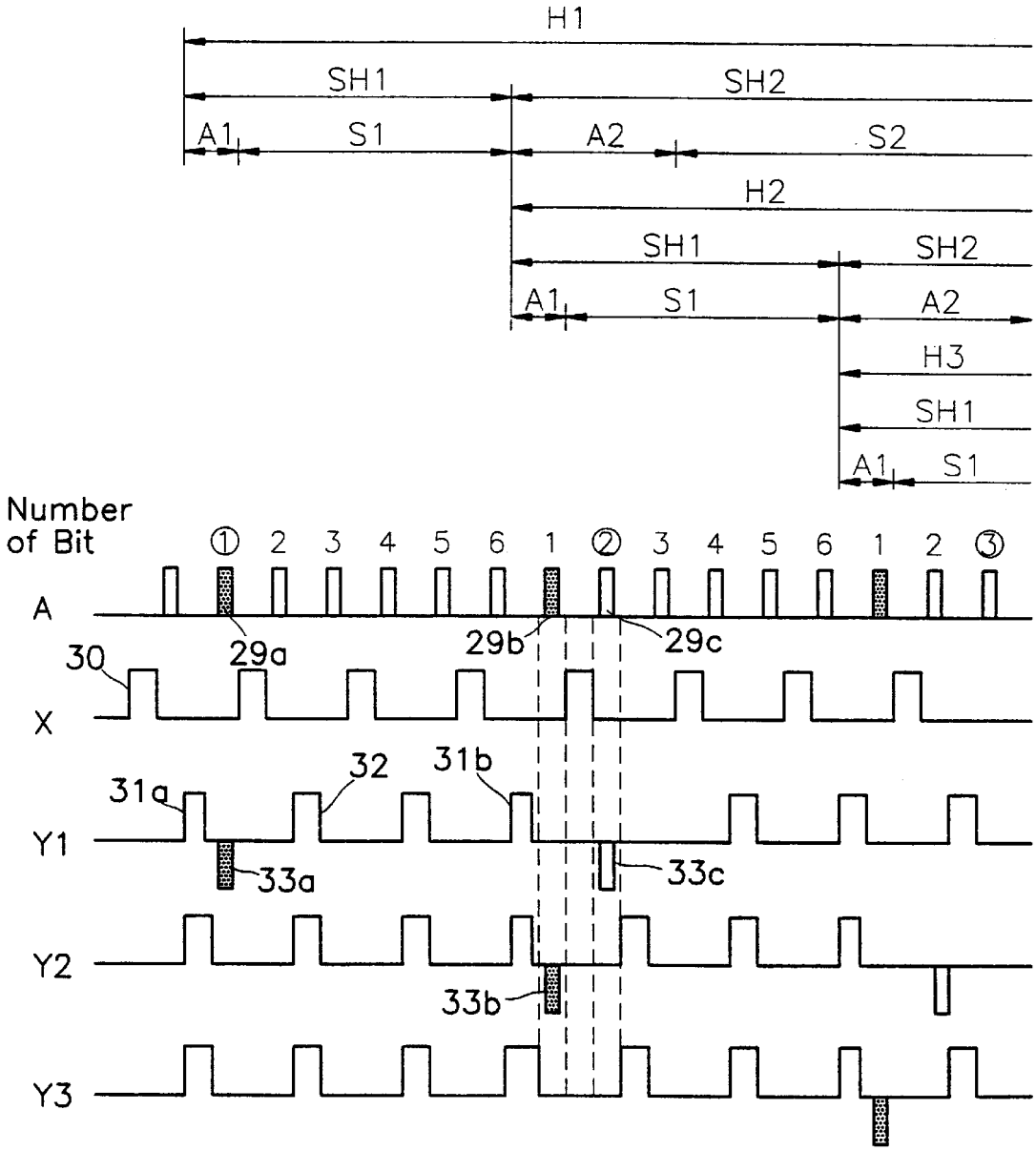
FIG. 6 (PRIOR ART)
FIG. 6 shows drive waveforms of a method for simultaneously driving the address electrode and the scanning electrode.
Figure 7:
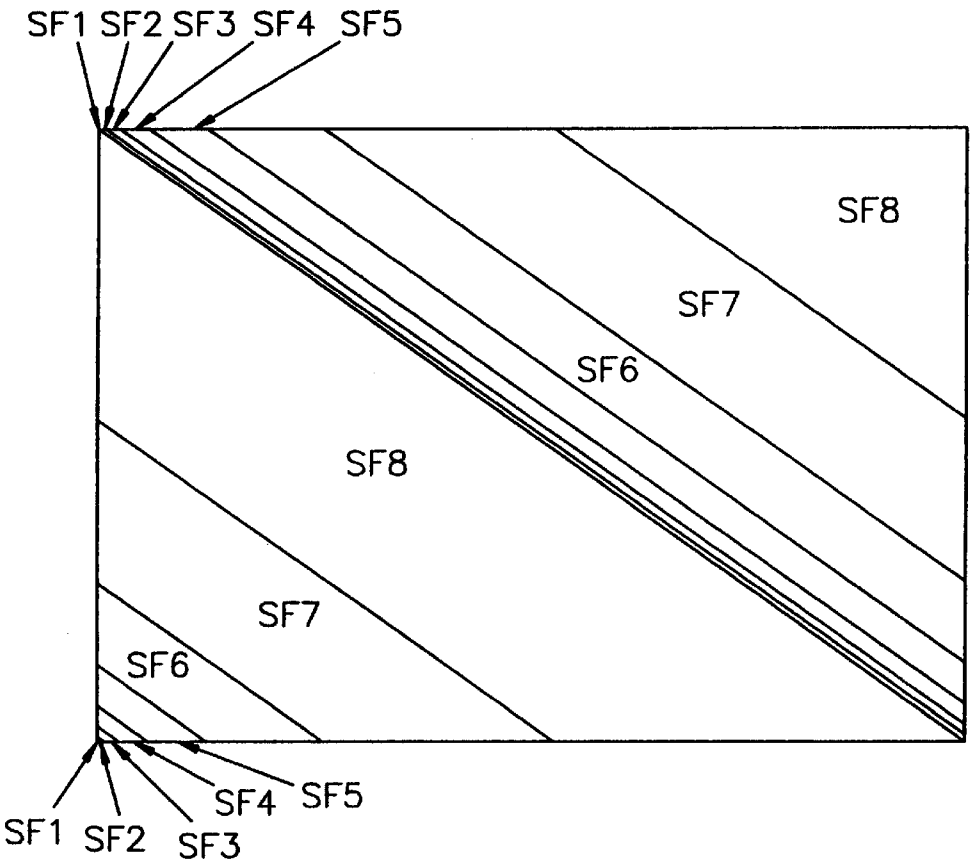
FIG. 7 (PRIOR ART)
FIG. 7 illustrates the gray scale display method of FIG. 6.

FIGS. 8A and 8B show the waveforms of an electrode drive signal for a basic electrode driving method according to the present invention, for driving the three electrode AC plasma display panel having the scanning electrode, the discharge sustaining electrode, and the address electrode crossing the discharge sustaining electrode as shown in FIG. 2B. Here, the common electrode is called an X electrode and the scanning electrode is called a Y electrode. In the method for driving the plasma display panel according to the present invention, a write discharge is generated in the discharge sustaining electrode in order to apply a well known erase address and a plurality of data pulses are applied between the discharge sustaining pulses, i.e. in each address time slot. At this time, addressing at a speed corresponding to the number of the data pulses applied to the address time slots can be performed, by sequentially applying the scanning pulses to the scanning electrodes so as to synchronize with the address pulses respectively. Thus, the number of horizontal scanning lines can be increased.

The waveforms of FIG. 8B are the same as those of FIG. 8A, but inverted. In FIGS. 8A and 8B, a discharge sustaining pulse 35 is selected with respect to an ith common electrode Xi and an i+mth common electrode Xi+m. A write discharge is generated by applying igniting pulses 38*a* and 38*c* to the ith scanning electrode Yi and the i+mth scanning electrode Yi+m, respectively. Thus, the wall charge is generated in the pair of electrodes Xi and Yi and the pair of electrodes Xi+m and Yi+m. Then, scanning pulses 37*a* and 37*c* are sequentially applied to the common electrodes Xi and Xi+m synchronized respectively with the first data pulses 34*a* and 34*c* in the current address time slot. The wall charges of unnecessary pixels are erased by the scan discharge. In the pixels whose wall charges are not erased, the discharge is performed by applying the discharge sustaining pulses 35. Here, the scanning electrodes Yi and Yi+m can be wired in common, since the waveforms applied to these electrodes are the same. In the pair of the I+1th common electrode Xi+1 and scanning electrode Yi+1, and the pair of the I+m+1th common electrode Xi+m+1 and scanning electrode Yi+m+1, the write discharge for the erase addressing is generated in the same way as the discharge sustaining pulse 36 of Yi+1 and Yi+m+1 by simultaneously applying the igniting pulses 38*b* and 38*d* to Xi+1 and Xi+m+1, respectively. Then, the scanning pulses 37*b* and 37*d* are sequentially applied to the scanning electrodes Yi+1 and Yi+m+1, synchronized respectively with the data pulses 34*b* and 34*d* applied in the current address time slot. The above processes are repeated on the remaining electrodes. In this case, since the same waveform is applied to the electrodes Xi+1 and Xi+m+1, since they are wired in common. The scanning is performed by repeatedly performing these processes. As a result, addressing can be performed at a speed corresponding to the number of data pulses inserted in the address time slots. Thus, the number of lines which can be scanned is increased.

Figure 9:
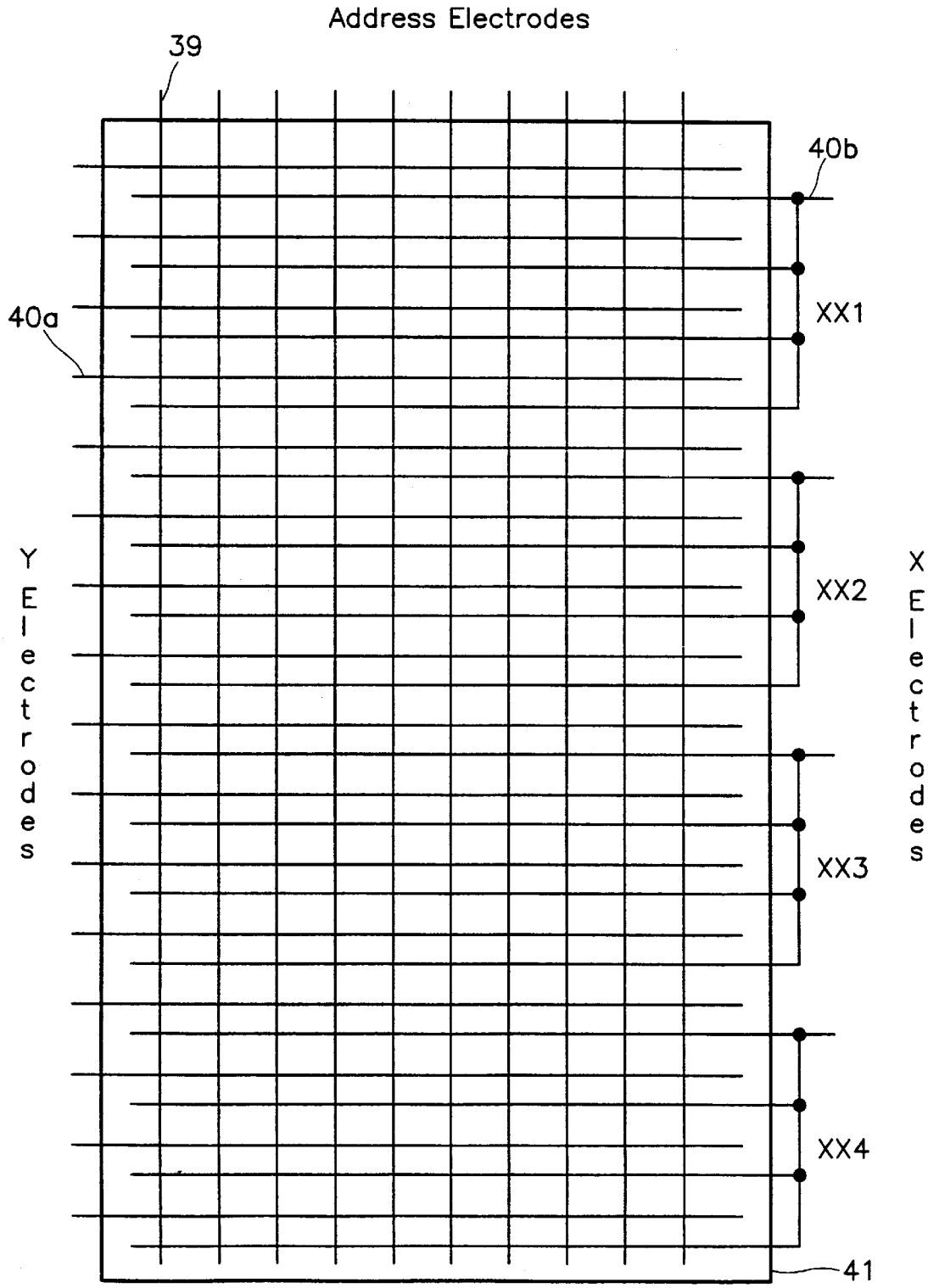
FIG. 9 shows the electrode wiring of the AC plasma display panel which allows the address electrode and the scanning electrode to be simultaneously driven, according to the present invention.

FIG. 9 shows an example of the wiring diagram of the plasma display panel of the present invention. This wiring structure can be formed in order to simplify applying the voltage of the above method. A plurality "P" of common electrode groups are formed. In this example, P=4. The four common electrode groups XX1, XX2, XX3, and XX4 are formed by commonly wiring the common electrodes of every four pairs of scanning and common electrodes, arranged on one surface of the two opposite surfaces. When the number of the scanning lines is k, the relationship m(4)×n(4)=k(16) is established. At this time, the electrodes wired in common are called common electrodes (X electrodes) and the electrodes which are not wired independently are called scanning electrodes (Y electrodes).

Figure 10A:
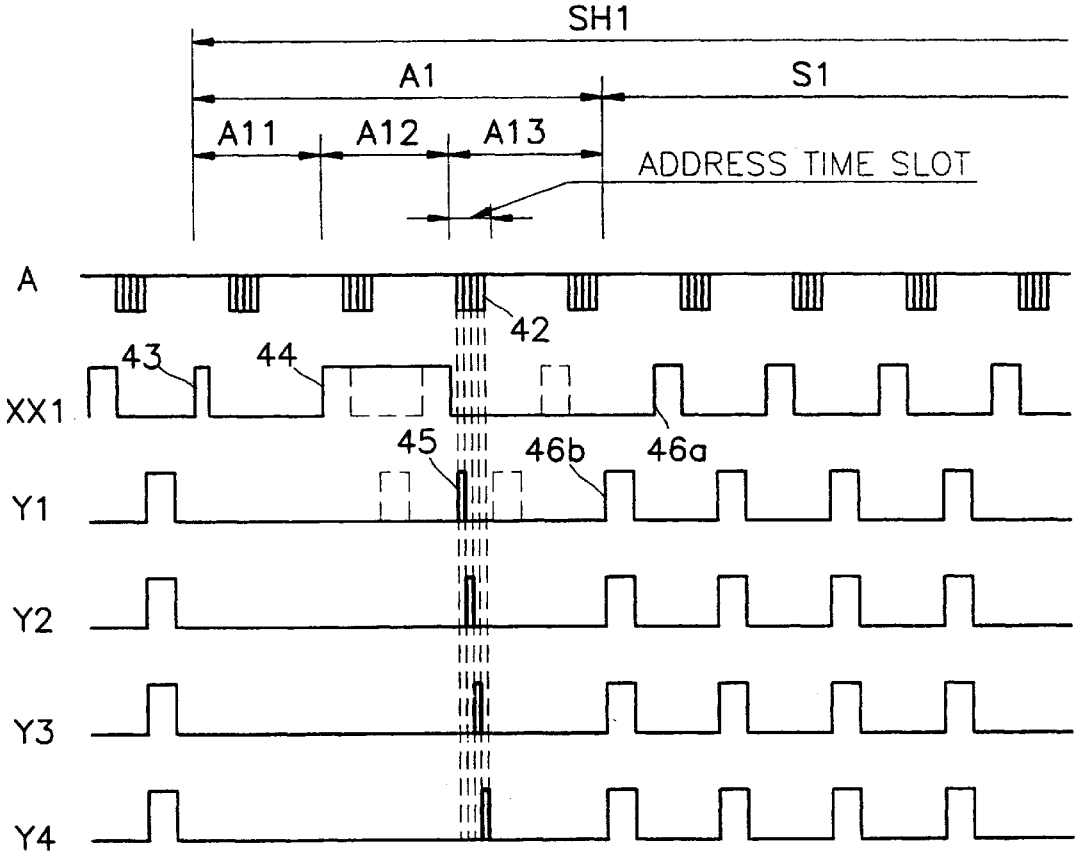
FIGS. 10A through 10D show the electrode drive waveforms when applying the method of FIGS. 8A and 8B and the electrode wiring structure of FIG. 9.
Figure 10B:
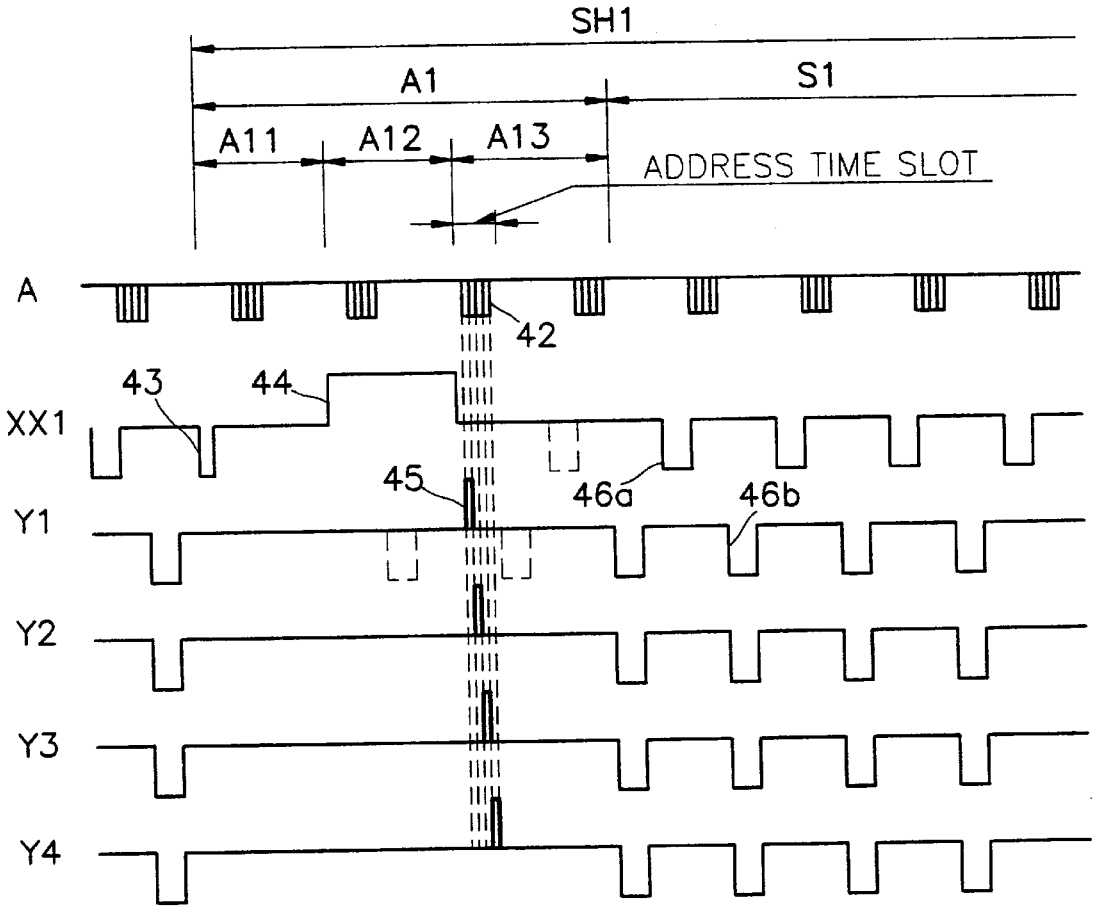
Figure 10C:
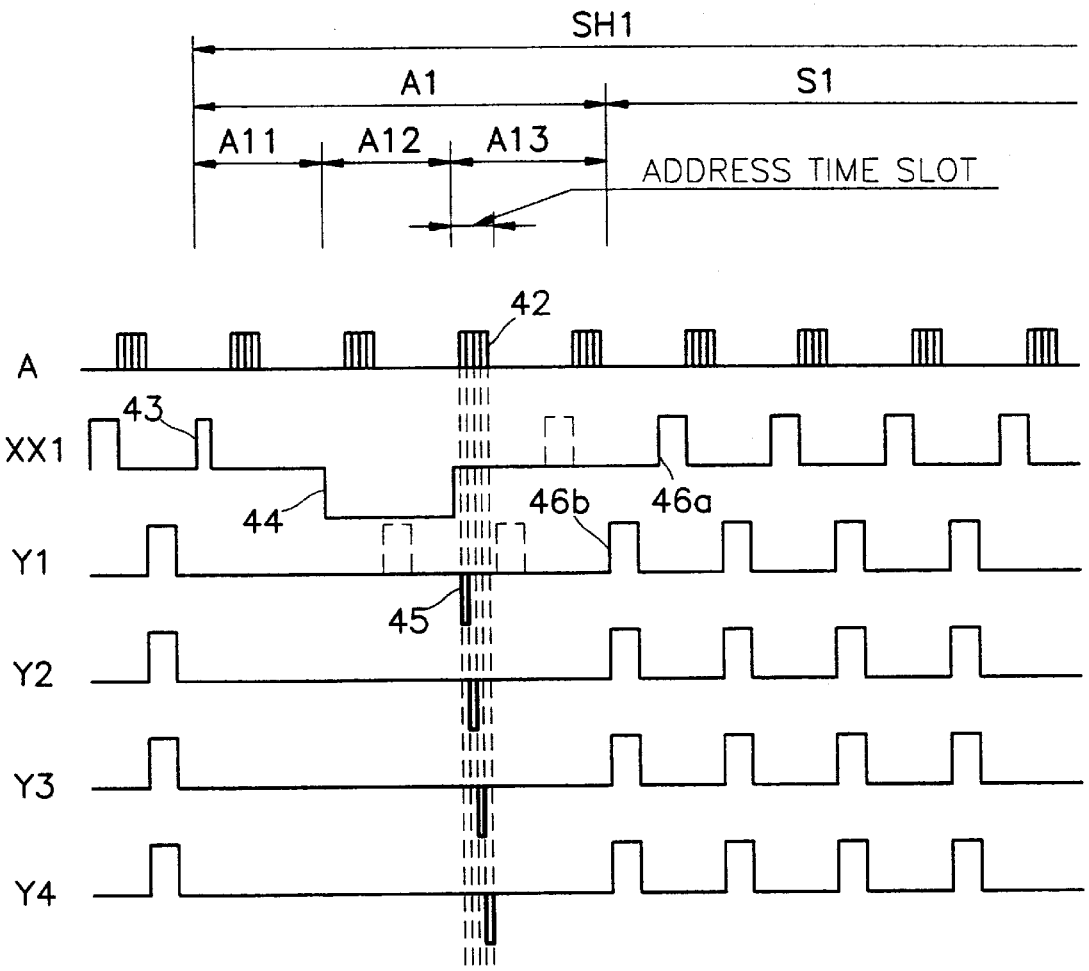
Figure 10D:
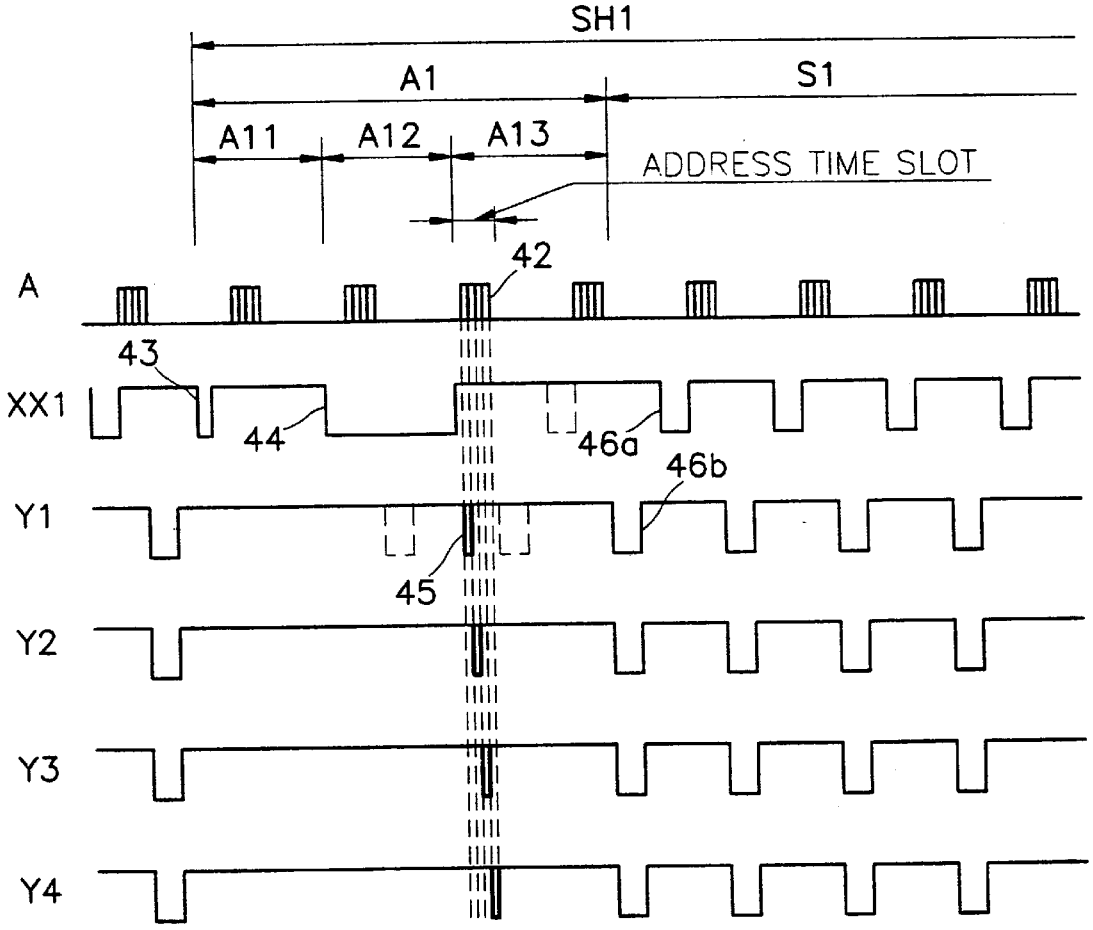
Figure 11A:
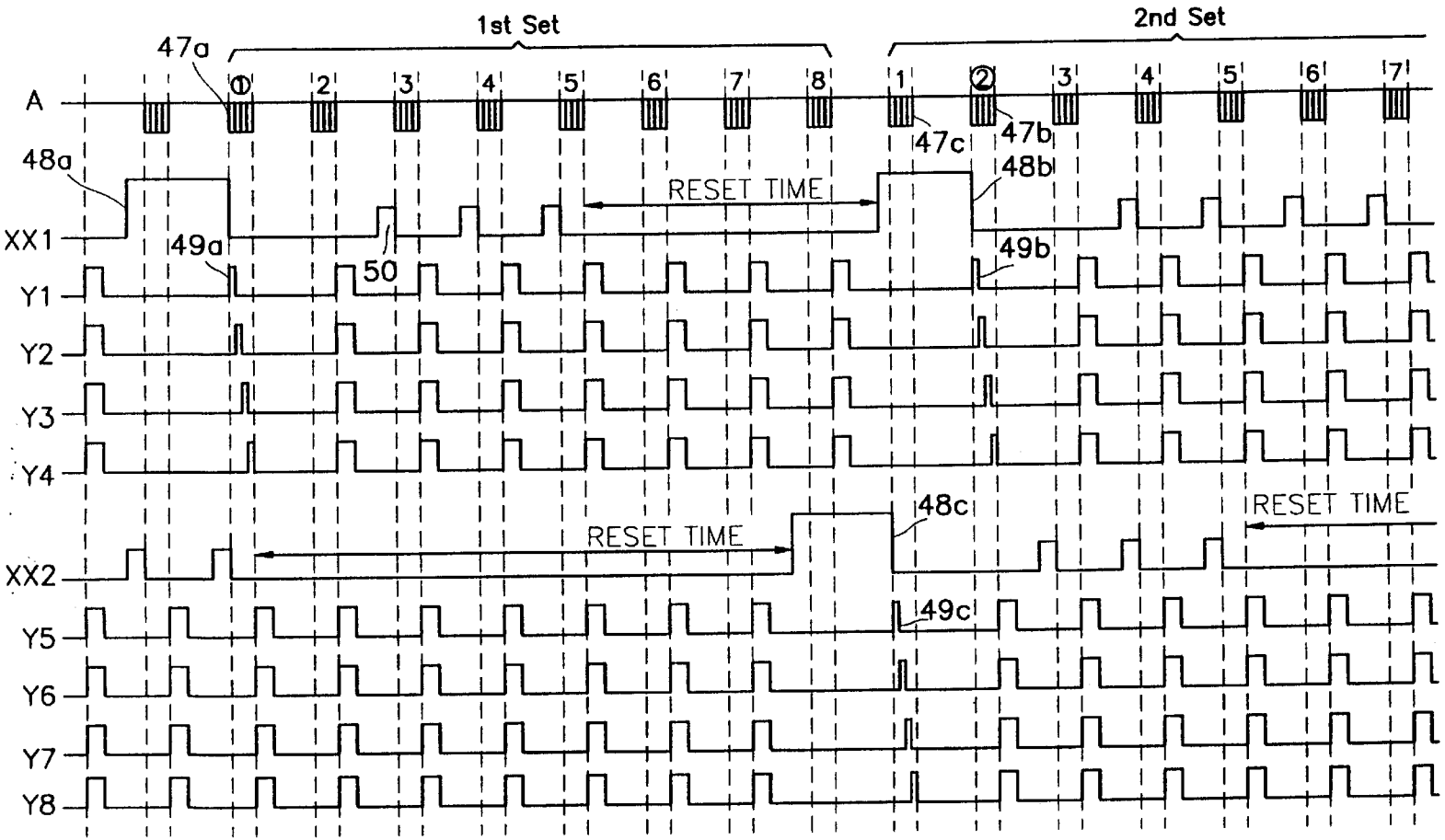
FIGS. 11A through 11D show the electrode drive waveforms of FIGS. 10A through 10D in detail.
Figure 11B:
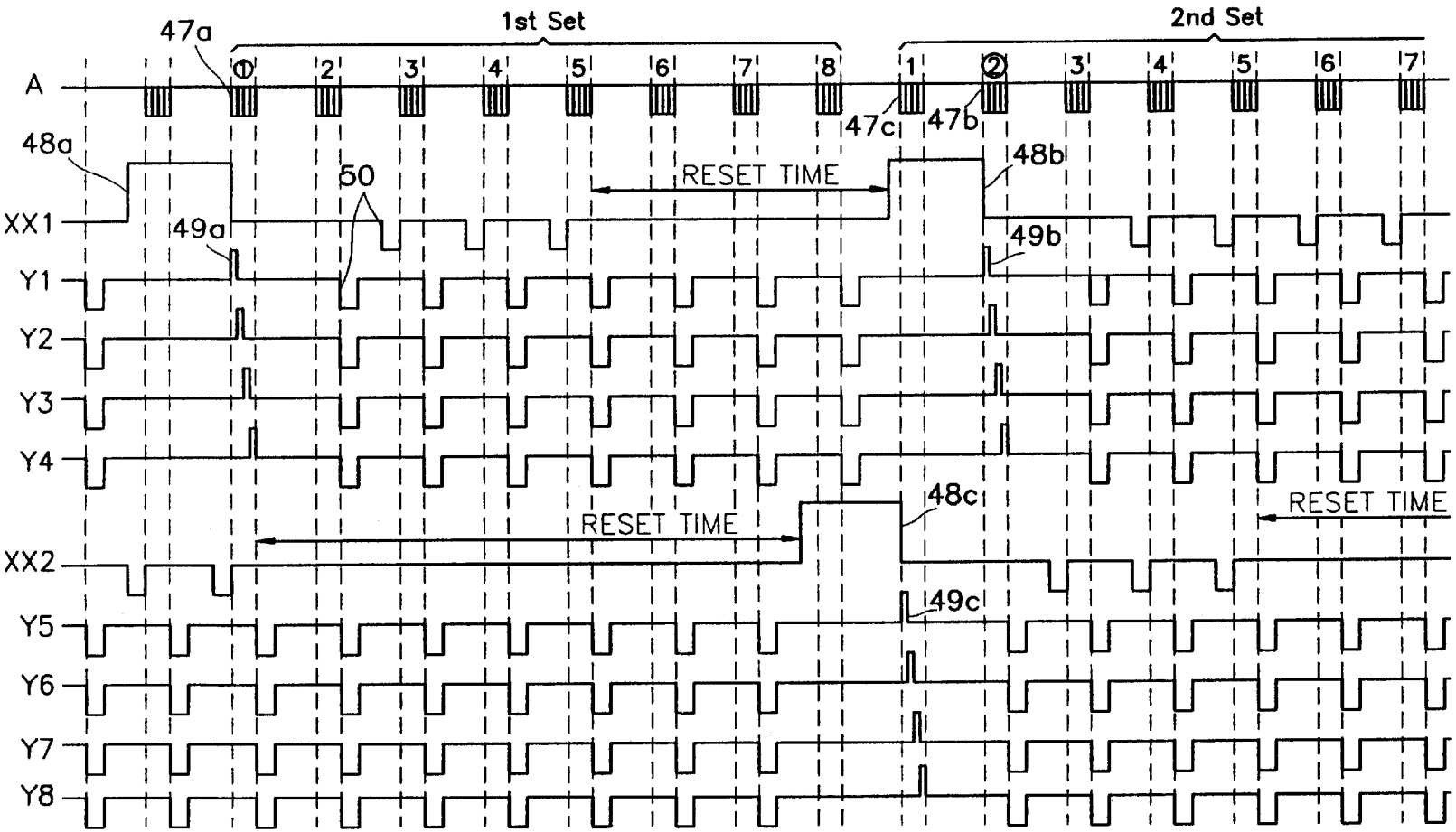
Figure 11C:
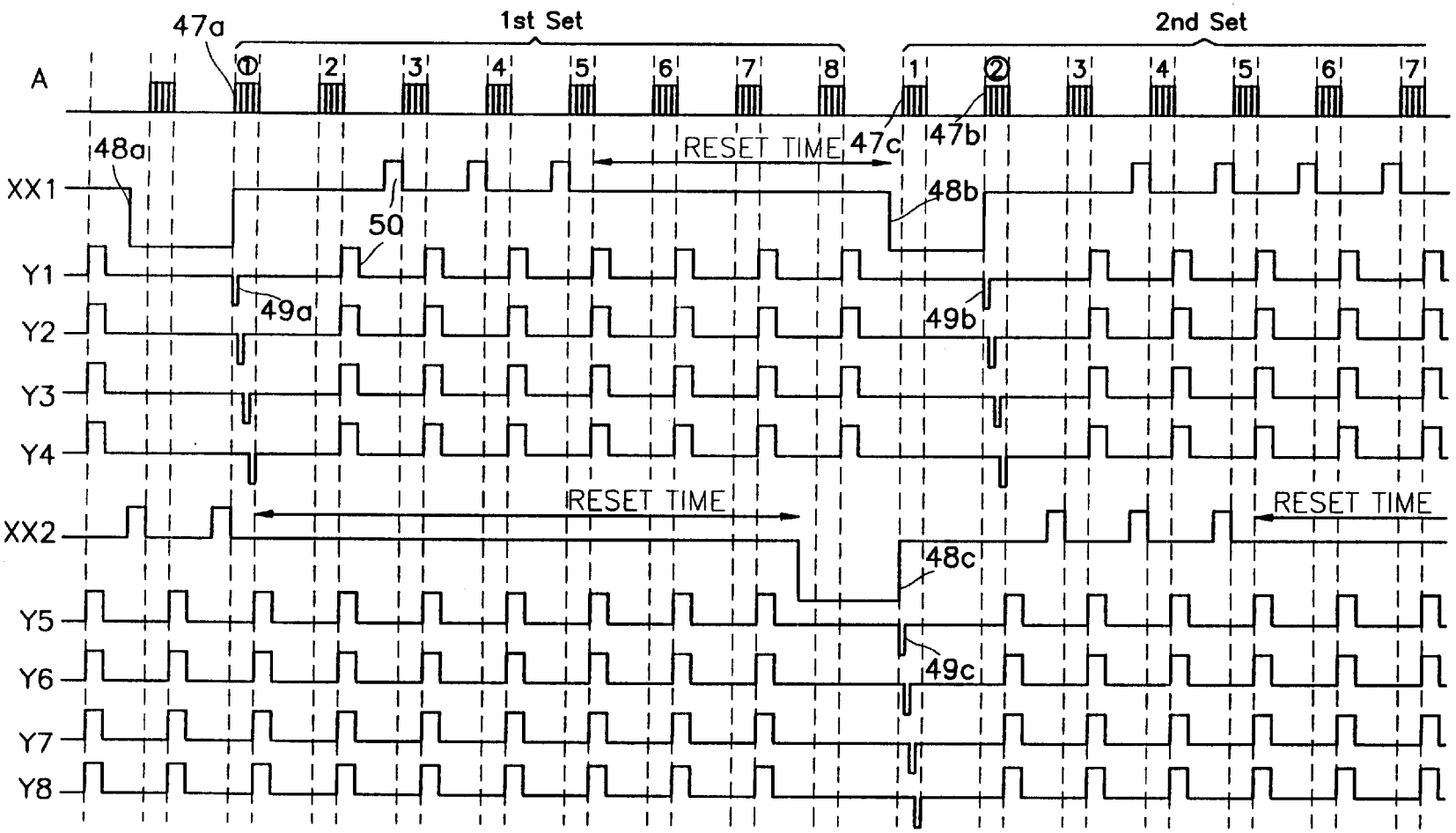
Figure 11D:
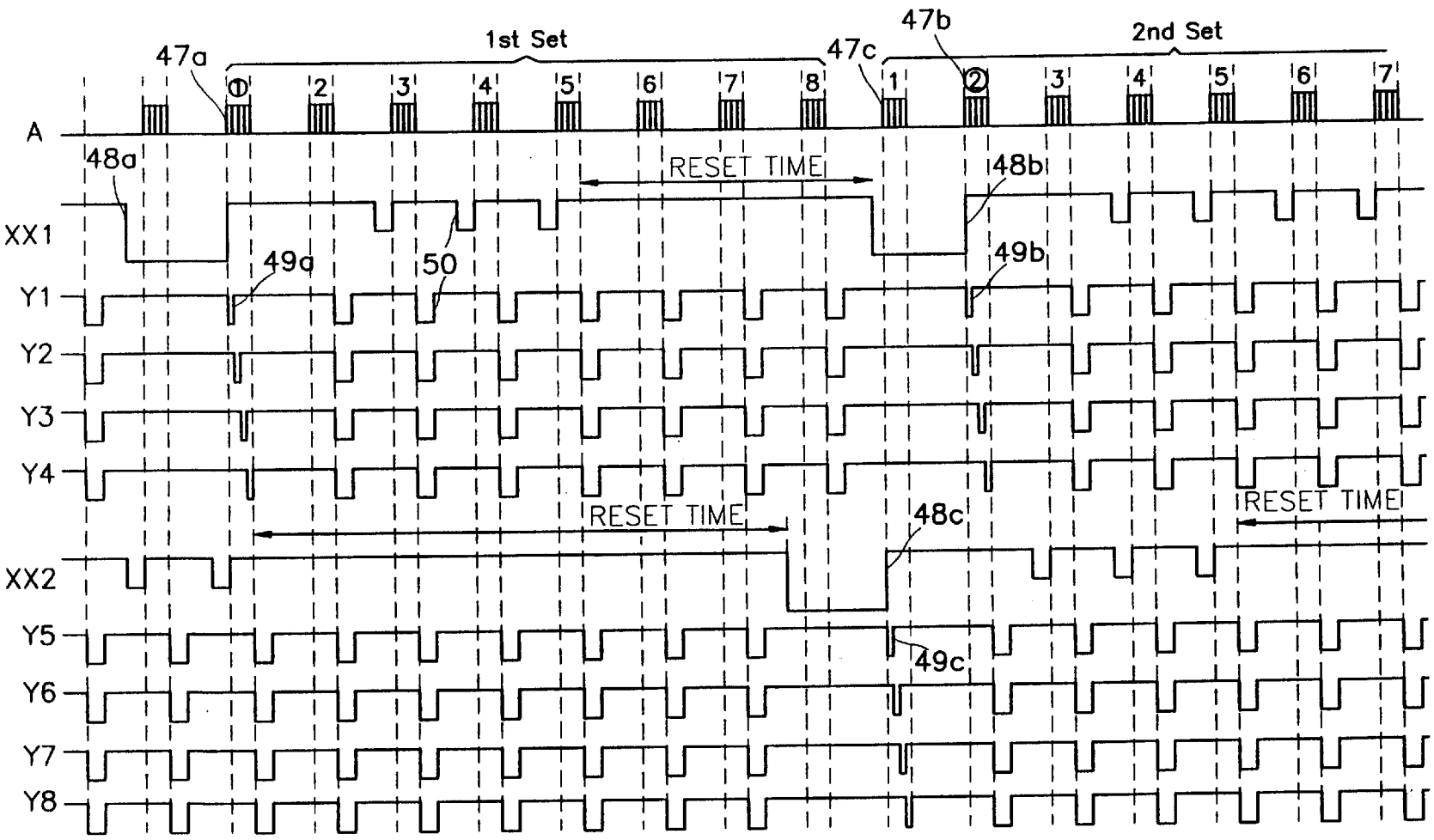

FIGS. 10A through 10D show waveforms of the electrode drive signals applied according to the electrode driving method of the present invention. It is noted from the drawings that a plurality of data pulses 42 are applied between the discharge sustaining pulses 46*a* of the common electrode XX1 and the discharge sustaining pulses 46*b* of the scanning electrodes Y1 through Y4 in the plasma display panel wired in the structure shown in FIG. 9. The period between the discharge sustaining pulse 46*a* and the preceeding or following discharge sustaining pulse 46*b* is called an address time slot. Scanning pulses 45 are sequentially applied to the scanning electrode, corresponding respectively to the data pulses 42 applied within one address time slot period. In FIGS. 10A through 10D, the periods between a discharge sustaining pulse 46*a* applied to the common electrode group XX1 and both the preceding and the following discharge sustaining pulses 46*b* applied to the scanning electrodes Y1 through Y4 are equal. In other words, the address time slots are arranged symmetrically about the discharge sustaining pulses. Four data pulses 42 are applied to one address time slot either preceeding or following each discharge sustaining pulse 46*a*. In this case, the address pulses 42 are applied to the following address time slot. A common electrode group XX1 and four scanning electrodes Y1, Y2, Y3, and Y4 are constructed using a number of pairs of the scanning electrodes and the common electrodes equal to the number of data pulses 42. In FIG. 10A, the data pulses 42 are negative pulses and the discharge sustaining pulses 46*a* and 46*b* are positive pulses. In FIG. 10B, the data pulses 42 are negative pulses and the discharge sustaining pulses 46*a* and 46*b* are negative pulses. In FIG. 10C, the data pulses 42 are positive pulses and the discharge sustaining pulses 46*a* and 46*b* are positive pulses. In FIG. 10D, the data pulses 42 are positive pulses and the discharge sustaining pulses 46*a* and 46*b* are negative pulses. Here, reference numerals 43 and 44 respectively denote an erasing pulse and an igniting pulse, which will be explained later. In the waveforms of the electrode drive signal of the plasma display panel shown in FIGS. 11A through 11D, the above-mentioned electrode driving principle is applied to displaying an actual eight bit gray scale (displaying $2^8$=256 shades of gray).

In the addressing method described in FIGS. 11A through 11D, space charges are formed in all the pairs of the scanning electrodes Y and the common electrodes X by simultaneously emitting light from one electrode group using an erase addressing method. The scanning pulses 49*a*, 49*b*, and 49*c* are sequentially applied to the scanning electrodes Y1 through Y8 included in the two electrode groups XX1, Y1, Y2, Y3 and Y4; and XX2, Y5, Y6, Y7, and Y8. The discharges generated by the addressing pulses 47*a*, 47*b*, and 47*c*, applied in synchronization with the scanning pulses 49*a*, 49*b*, 49*c*, respectively, selectively erase the wall charges of pixels unnecessary for display discharge. The discharge sustaining pulses 50 are each applied after performing various sequential scanning in one address slot. In this method, one horizontal synchronizing period is divided into a plurality of auxiliary horizontal synchronizing periods in order to display the gray scale steps. Here, the one horizontal synchronization period 1H is divided into eight auxiliary horizontal synchronizations periods SH1 through SH8, in order to represent the 256 gray scale steps by the combinations of the 8 bits (1:2:4:8:16:32:64:128). The horizontal synchronization periods have discharge sustaining periods corresponding to the brightness of the respective bits. In case the least bit has three sustaining pulses, each bit of the reference gray scale of 8 bits have 3, 6, 12, 24, 48, 96, 192, and 384 discharge sustaining pulses, respectively. The picture of one frame is divided into a plurality of partial pictures. The gray scales of the plurality of partial pictures are displayed by a plurality of electrode groups XX1, Y1, Y2, Y3, and Y4; XX2, Y5, Y6, Y7, and Y8; XX3, Y9, . . . corresponding respectively to the partial pictures. Since a plurality of auxiliary horizontal synchronization periods SH1 through SH8 are necessary in order to display the partial pictures displayed by the respective electrode groups, it is necessary to provide a method for arranging the auxiliary horizontal synchronization periods so that the addresses 1 through 8 of the respective auxiliary horizontal synchronizations periods do not overlap each other. Here, a well known 1 bit advance sequential arranging method is used. The scanning electrode drive signals and the common electrode drive signals which are divided into a plurality of periods, i.e., sets respectively including eight address slots 1–8, are respectively applied to one common and scanning line group XX1, Y1–Y4. The auxiliary horizontal synchronization pulses(i.e., scan pulses) 49*a*, 49*b* . . . are respectively arranged in the order of 1st bit (slot) of the first set, 2nd bit (slot) of the second set, . . . . In the second set, which is delayed by one set, the auxiliary horizontal synchronization pulses (i.e., scan pulses) 49*c* . . . are arranged in the order of 1st bit of its first set, 2 bits of its second set, . . . , in the common and scanning line group XX2, Y5–Y8. Since the respective auxiliary horizontal synchronization pulses (49*a*, 49*b*, . . . , 49*c*, . . . ) are arranged so as to precede by one address slot at the same sets, the respective address pulses do not overlap. In FIGS. 11A through 11D, the combination of positive and negative pulses correspond to the those of FIGS. 10A through 10D. In FIG. 12, such an electrode driving method is applied to a 1TV frame. A method for displaying 256 gray scale step by the combinations of the 8 bits is shown in the case that the number of horizontal scanning lines is 480. In this case, when four address pulses are applied to each address slot, the total number of horizontal scanning line groups becomes 120 using four scanning electrodes as an electrode group. The respective stopping periods, addressing periods, and discharge sustaining periods are arranged as shown in FIG. 12. The 6th and 7th bits fall outside the boundary of the diagram, and therefore are not shown. Also, 16th through 120th electrode groups are omitted.

In another embodiment of the present invention, the wiring method is modified in order to prevent cross talk between adjacent lines which can occur due to the short period of the address slot when the scanning involves skipping a plurality of lines. The new wiring structure is shown in FIG. 13. Namely, a number of common electrodes equal to the number of data pulses are wired as each common electrode group XX1, XX2, XX3, and XX4. The electrodes of each group are separated by a number of common electrodes equal to the number of common electrode groups. Addressing is performed by sequentially applying the scanning pulses to the scanning electrodes 52*a* included in the common electrode groups XX1, XX2, XX3, and XX4 and applying a plurality of data pulses to the address electrodes 51. Wall charges are formed at pixels selected in this way, and a picture is formed by erasing the wall charges of pixels unnecessary to a display discharge.

In FIGS. 14A through 14D, the periods between a discharge sustaining pulse 58*a* applied to a common electrode group XX1) and both the preceding and following discharge sustaining pulses 58*b* applied to the scanning electrodes Y1 through Y8 are equal. In other words, the address time slots are arranged symmetrically about the discharge sustaining pulses. Two sets of four address pulses 54*a* and 54*b* are respectively applied in the two address time slots. Thus both the address time slots preceding and following each discharge sustaining pulse are filled, as opposed to filling just one as described in FIGS. 10A through 10D and 11A through 11D. In this case, the common and scanning electrode groups require less driving circuitry since the number of such groups is reduced by half. In FIGS. 14A through 14D, the combinations of positive and negative pulses correspond to those of FIGS. 10A through 10D. FIG. 15 is an electrode wiring diagram of a plasma display panel for realizing the embodiment illustrated by 14A through 14D. FIG. 16 shows the waveforms of an electrode drive signal, illustrating the case when the driving method for FIG. 14A is used. In FIG. 15, since four data pulses are inserted into each of both the preceding and following symmetrical address time slot, eight common electrodes 60*b* are wired together to form each of the common electrode groups XX1 and XX2. Pixels are selected by the eight data pulses applied to the address electrodes 59 and the scanning pulses sequentially applied to the scanning electrodes 60*a* of one common electrode group. Referring to FIG. 16, four data pulses are applied to an address electrode (A) during both the preceding and following address time slots. Thus, eight address pulses are applied during each period between the discharge sustaining pulses. Therefore, in the first electrode group XX1, Y1 through Y8, the selected pixels are addressed by the data pulses 62*a* and 62*b*, applied after the igniting pulses 63*a* and 63*b*, and by the scanning pulses 65*a* and 65*b* sequentially applied to the scanning electrodes Y1 through Y8 corresponding to the data pulses. In the second electrode group XX2, Y9 through Y16, the selected pixels are addressed by the data pulses 62*c* applied after the igniting pulse 63*c*, and by the scanning pulses 65*c* sequentially applied to the scanning electrodes Y9 through Y16 corresponding to the data pulses. Also, in the gray scale display method described in FIG. 16, remaining wall charges may be erased by inserting a narrow pulse (79*a* and 79*b* of FIG. 19) after the discharge sustaining pulse alignment of each reference bit at the scanning electrodes is terminated. Doing so may increase the correctness of the address. The wall charges may alternatively be allowed to naturally decrease by inserting a period of less than 100 μsec, after the final discharge sustaining pulse of each gray scale display periods.

FIG. 17 is a wiring diagram of a plasma display panel 69 which, when applying the scanning pulses corresponding to eight data pulses applied to an address electrode 67, skips a plurality of electrodes in order to reduce cross talk. Therefore, the common electrodes X selected at every eight common electrode are wired together.

Figure 18B:
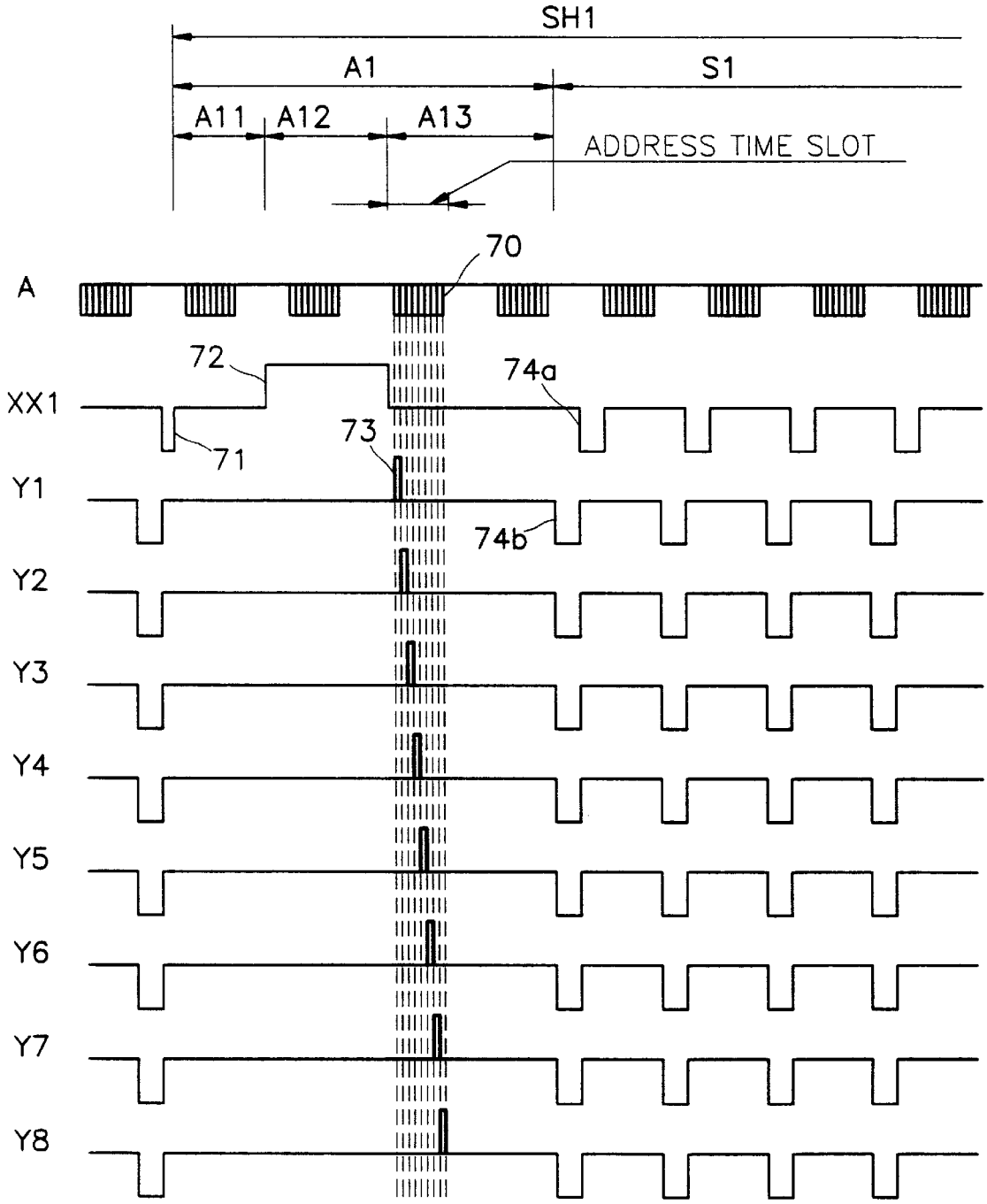
Figure 18C:
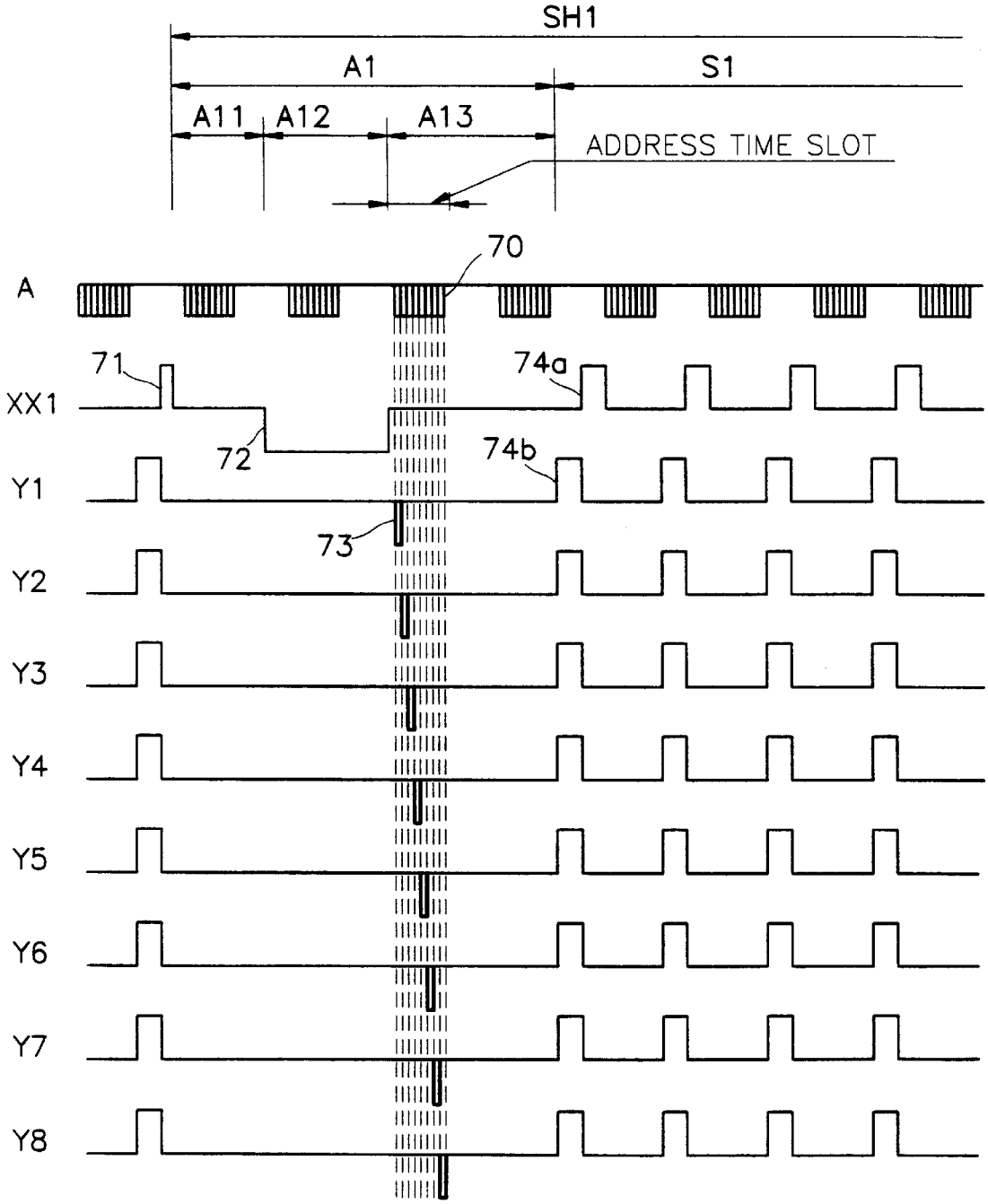
Figure 18D:
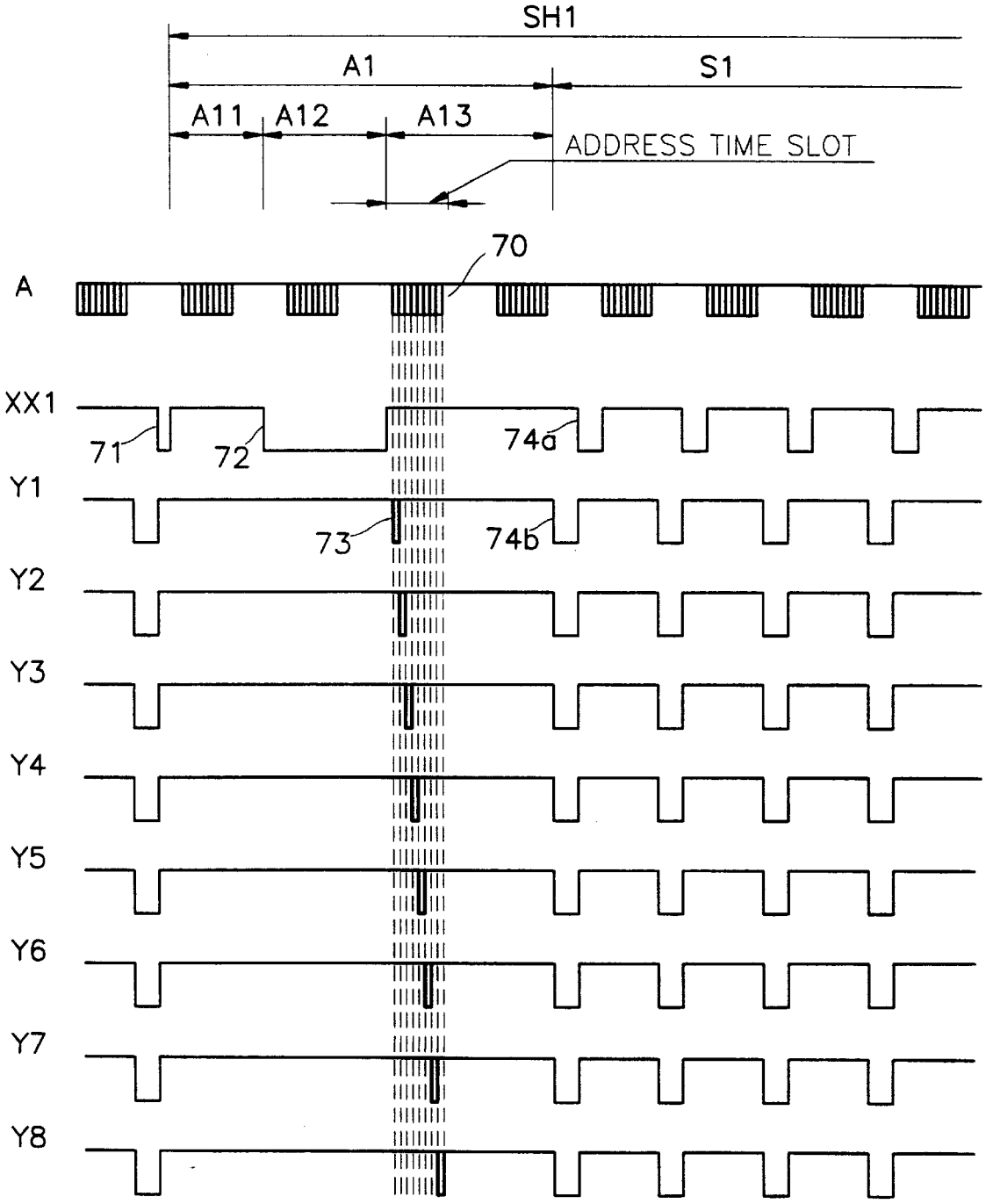

FIGS. 18A through 18D show another embodiment of the present invention, in which one of each pair of address slots is extended, making the periods between a discharge sustaining pulse 74*a* applied to the common electrode group XX1 and the discharge sustaining pulses 74*b* applied to the scanning electrodes Y1 through Y8 unequal. In other words, the address time slots are arranged asymmetrically about the discharge sustaining pulses. Then, eight data pulses 70 are applied to each of the large address time slots. Here, the larger address time slot is the one which follows the discharge sustaining pulse 74*a*. In this case, it is possible to reduce the necessary driving circuitry by half, as mentioned in the above embodiment. In FIG. 18A, data pulses 70 are negative pulses and discharge sustaining pulses 74*a* and 74*b* are positive. In FIG. 18B, the data pulses 70 are negative and the discharge sustaining pulses 74*a* and 74*b* are negative. In FIG. 18C, the data pulses 70 are positive and the discharge sustaining pulses 74*a* and 74*b* are positive. In FIG. 18D, the data pulses 70 are positive pulses and the discharge sustaining pulses 74*a* and 74*b* are negative.

FIG. 19 shows the waveforms of the electrode drive signals according to the driving method of FIG. 18A. Here, data pulses 75*a* and 75*b* correspond to scanning pulses 77*a* and 77*b* sequentially applied to the scanning electrodes Y1 through Y8 of the first common electrode group XX1, during the first and second sets. Scanning pulses 77*c* sequentially applied to scanning electrodes Y9 through Y16 of the second common electrode group XX2 perform addressing and correspond to the first data pulse of the second set. In this case, it is possible to apply narrow pulses 79*a* and 79*b* to erase the wall charges after the discharge sustaining pulse alignment 78 of the scanning electrode is terminated. Doing so may increase the correctness of the address. The wall charges may alternatively be allowed to naturally decrease by inserting a period of less than 100 μsec, after the final discharge sustaining pulse of each gray scale display period. Reference numerals 76*a*, 76*b*, and 76*c* denote igniting pulses applied before the addressing is performed.

In FIG. 20, more address pulses are inserted into the asymmetrical address slots, in order to drive more scanning lines than in the embodiment of FIG. 19. Sets of 10 address pulses 80*a*, 80*b*, and 80*c* are applied to each of the address slots in order to drive $1024(2^{10})$ common electrodes and scanning electrodes. Also, in this case, a plurality of discharges having the function of simultaneous erase and write are generated by introducing igniting pulses 81*a*, 81*b*, and 81*c* and erasing pulses 83*a*, 83*b*, and 83*c* before the auxiliary horizontal synchronization periods of the respective sets. Accordingly, in the selected pixels, the wall charges are erased and the write discharge is performed. An address separate display discharging method is applied to the horizontal scanning line groups. It is possible to perform more effective addressing by inducing positive wall charges (for example, Ar+) toward the scanning electrode Y by applying barrier voltages 82*a*, 82*b*, and 82*c* to the common electrode groups XX1, XX2, . . . during the address periods. Such a write addressing method can be applied to an embodiment in which the erasing addressing method is used. In this case, it is possible to apply narrow pulses 86*a* and 86*b* for erasing the wall charges after terminating the discharge sustaining pulse alignment 85 of the common electrode groups. Doing so may increase the correct addressing. Alternatively the wall charges may be allowed to decrease naturally by inserting a period of less than 100 μsec after the final discharge sustaining pulse of each gray scale display periods.

FIG. 21 shows another embodiment of the present invention, in which the numbers 1, 2, . . . , and 8 of the auxiliary horizontal synchronization periods are given. Two address time slots are skipped between each auxiliary horizontal synchronization period and the following one, in order to remove interference generated by data pulses in the case that the address time slots overlap an igniting discharge period of the common electrode. In FIG. 21, the data pulses are applied to both the preceding and following address time slots, and the address time slots are arranged symmetrically, as shown in FIG. 16. In the address time slots marked "NA", to which the address pulses are not applied, the discharge interference generated by the address pulses disappears since the common electrode XX2 performs an igniting discharge (caused by the igniting pulse 63*c*).

As mentioned above, the method for driving an AC surface discharge plasma display panel according to the present invention uses a parallel driving method which is known to provide much better brightness than a separate driving method. In the parallel driving method, the addressing and discharge sustaining are performed simultaneously, as opposed to the separate driving being performed. Periods between the discharge sustaining pulses applied to the scanning electrodes and those applied to the common electrodes are defined as address time slots, and a plurality of data pulses are applied in the address time slot. A number of common electrodes equal to the number of data pulses are wired in common to form one common electrode group. Doing so overcomes the restriction on the number of horizontal scanning lines which can be scanned, which is a drawback of the conventional addressing and discharge sustaining parallel drive method. According to the discharge sustaining parallel driving method according to the present invention, it is possible to use the addressing and discharge sustaining parallel driving method to drive over 1,000 scanning lines with a 8 bit gray scale.

What is claimed is:

1. A method of driving an AC plasma display panel for displaying a picture including gray scale images comprising:

dividing a horizontal synchronization period into a plurality of sub-periods;

sequentially applying different numbers of discharge sustaining pulses to first and second electrodes of the AC plasma display panel the AC plasma display panel having an n matrix with k rows and n columns, k pairs of first and second electrodes parallel to each other and located on a first substrates, and n third electrodes perpendicular to the first and second electrodes and located on a second substrate, the second substrate being parallel to the first substrate, wherein the second electrodes are common electrodes and are grouped into p common wiring groups, the first electrodes are scanning electrodes, and the third electrodes are address electrodes;

setting address time slot periods in a period between discharge sustaining pulses and applying a plurality of data pulses to an address electrode during the respective address time slot periods; and sequentially selecting the common wiring groups to correspond to the plurality of data pulses and sequentially applying scanning pulses corresponding to the plurality of data pulses, the plurality of data pulses corresponding to the common electrodes of selected common wiring groups.

2. A method of driving an AC plasma display panel for displaying a picture including gray scale images comprising:

dividing a horizontal synchronization period into a plurality of sub-periods;

sequentially applying different numbers of discharge sustaining pulses to first and second electrodes of the AC plasma display panel, the AC plasma display panel having an n matrix with k rows and n columns, k pairs of first and second electrodes parallel to each other and located on a first substrate, and n third electrodes perpendicular to the first and second electrodes and located on a second substrate, the second substrate being parallel to the first substrate, wherein the second electrodes are common electrodes and are grouped into p common wiring groups, the first electrodes are scanning electrodes, and the third electrodes are address electrodes;

setting address time slot periods in a period when discharge sustaining pulses are not applied to the first and second electrodes and applying a plurality of data pulses to an address electrode during the respective address time slot periods; and sequentially selecting the common wiring groups to correspond to the plurality of data pulses and sequentially applying scanning pulses corresponding to the plurality of data pulses, the plurality of data pulses corresponding to the common electrodes of selected common wiring groups, wherein a number of the address time slot periods equal to a number of reference gray scale bits are repeatedly applied, corresponding to the respective horizontal synchronization periods, to the address electrodes, the scanning electrodes are sequentially selected, corresponding to the respective address time slot periods, and gray scale display periods are selected corresponding to selected scanning electrodes, preceding the gray scale display period of a previously selected scanning electrode by one bit.

3. A method of driving an AC plasma display panel for displaying a picture including gray scale images comprising:

dividing a horizontal synchronization period into a plurality of sub-periods;

sequentially applying different numbers of discharge sustaining pulses to first and second electrodes of the AC plasma display panel, the AC plasma display panel having an n matrix with k rows and n columns, k pairs of first and second electrodes parallel to each other and located on a first substrate, and n third electrodes perpendicular to the first and second electrodes and located on a second substrate, the second substrate being parallel to the first substrate, wherein the second electrodes are common electrodes and are grouped into p common wiring groups, the first electrodes are scanning electrodes, and the third electrodes are address electrodes;

forming wall charges in every pair of the first and second electrodes by applying igniting pulses to the pairs of first and second electrodes before addressing;

selectively applying addressing pulses and scanning pulses to the address electrodes and the scanning electrodes and erasing the wall charges only in selected pixels;

setting address time slot periods in a period between discharge sustaining pulses and applying a plurality of data pulses to an address electrode during the respective address time slot periods; and sequentially selecting the common wiring groups to correspond to the plurality of data pulses and sequentially applying scanning pulses corresponding to the plurality of data pulses, the plurality of data pulses corresponding to the common electrodes of selected common wiring groups.

4. The method of claim 3, wherein the wall charges generated during a previous gray scale display period are erased by decreasing width of a final discharge sustaining pulse to be narrower than widths of other discharge sustaining pulses among respective gray scale displaying periods.

5. The method of claim 4, wherein the width of the final discharge sustaining pulse is less than 2 $\mu$s.

6. The method of claim 3, wherein the wall charges are naturally decreased by inserting a period of less than 100 $\mu$s after the final discharge sustaining pulse among respective gray scale displaying periods.

7. A method of driving an AC plasma display panel for displaying a picture including gray scale images comprising:

dividing a horizontal synchronization period into a plurality of sub-periods;

sequentially applying different numbers of discharge sustaining pulses to first and second electrodes of the AC plasma display panel, the AC plasma display panel having an n matrix with k rows and n columns, k pairs of first and second electrodes parallel to each other and located on a first substrate, and n third electrodes perpendicular to the first and second electrodes and located on a second substrate, the second substrate being parallel to the first substrate, wherein the second electrodes are common electrodes and are grouped into p common wiring groups, the first electrodes are scanning electrodes, and the third electrodes are address electrodes;

erasing wall charges generated during a previous gray scale displaying period by decreasing width of a final discharge sustaining pulse to be narrower than widths of other discharge sustaining pulses among respective gray scale displaying pulses, and erasing the wall charges in every pair of first and second electrodes by applying igniting pulses to the pairs of the first and second electrodes before addressing;

selectively applying data pulses and scanning pulses to the addressing electrodes and to the scanning electrodes and forming wall charges only in selected electrodes;

setting address time slot periods in a period when discharge sustaining pulses are not applied to the first and second electrodes and applying a plurality of the data pulses to an address electrode during the respective address time slot periods; and sequentially selecting the common wiring groups to correspond to the plurality of data pulses and sequentially applying the scanning pulses corresponding to the plurality of data pulses, the plurality of data pulses corresponding to the common electrodes of selected common wiring groups.

8. The method of claim 7, wherein the width of the final discharge sustaining pulse is less than 2 $\mu$s.

9. The method of claim 7, wherein the wall charges are naturally decreased by inserting a period of less than 100 $\mu$sec after the final discharge sustaining pulse among the respective gray scale displaying periods.

* * * * *